US011054849B2

(12) United States Patent
Chien

(10) Patent No.: US 11,054,849 B2
(45) **Date of Patent: *Jul. 6, 2021**

(54) SOURCE DRIVER AND OUTPUT BUFFER THEREOF

(71) Applicant: HIMAX TECHNOLOGIES LIMITED, Tainan (TW)

(72) Inventor: Chia-Chu Chien, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 142 days.

This patent is subject to a terminal disclaimer.

(21) Appl. No.: 16/509,514

(22) Filed: Jul. 12, 2019

(65) Prior Publication Data

US 2021/0011505 A1 Jan. 14, 2021

(51) Int. Cl.
*G09G 3/36* (2006.01)
*G05F 1/575* (2006.01)

(52) U.S. Cl.
CPC ..... *G05F 1/575* (2013.01); *G09G 2310/027* (2013.01); *G09G 2310/0291* (2013.01); *G09G 2330/021* (2013.01)

(58) Field of Classification Search
CPC ..... G09G 2310/0291; G09G 3/3696; G09G 2330/028; G09G 3/3275; G09G 2310/0286; G09G 2310/0289; G09G 2370/08; G09G 2310/027; G09G 3/3685
See application file for complete search history.

(56) References Cited

U.S. PATENT DOCUMENTS

| | | | | |
|---|---|---|---|---|
| 9,461,624 | B2 * | 10/2016 | Ravula Lakshmi | H03K 3/011 |
| 2015/0084694 | A1 * | 3/2015 | Lee | H03F 3/301 330/255 |
| 2017/0032755 | A1 * | 2/2017 | Ko | G09G 3/3648 |
| 2019/0206565 | A1 | 7/2019 | Shelton, IV | |

FOREIGN PATENT DOCUMENTS

| | | |
|---|---|---|
| CN | 103106883 | 5/2013 |
| TW | 201211972 | 3/2012 |
| WO | 2019123738 | 6/2019 |

OTHER PUBLICATIONS

"Office Action of Taiwan Counterpart Application", dated Dec. 9, 2020, p. 1-p. 4.

* cited by examiner

*Primary Examiner* — Duc Q Dinh
(74) *Attorney, Agent, or Firm* — JCIPRNET

(57) ABSTRACT

A source driver including an output buffer and a feedback circuit is provided. The output buffer includes an input stage circuit, an output stage circuit, a rising control circuit, and a falling control circuit. The input stage circuit correspondingly generates a first gate control voltage and a second gate control voltage according to an input voltage and a first feedback voltage. The output stage circuit correspondingly generates an output voltage according to the first gate control voltage and the second gate control voltage. The feedback circuit generates and outputs the first feedback voltage corresponding to the output voltage to the input stage circuit. The rising control circuit and the falling control circuit compare the input voltage with the first feedback voltage, and pull down (or pull up) the first gate control voltage and the second gate control voltage according to the comparison result.

34 Claims, 14 Drawing Sheets

SOURCE DRIVER AND OUTPUT BUFFER THEREOF

BACKGROUND

Technical Field

The invention relates to a display device, and particularly relates to a source driver and an output buffer thereof.

Description of Related Art

Generally, a source driver is used for driving a plurality of data lines (or referred to as source lines) of a display panel. The source driver is configured with a plurality of driving channel circuits, and each of the driving channel circuits drives a corresponding one of the data lines through a different output buffer. The source driver is configured with output buffers, and the output buffers may gain analog voltages of Digital-to-Analog Converters (DAC) for outputting to the data lines (or referred to as source lines) of the display panel. As a resolution and/or a frame rate of the display panel increases, a charging time for a scan line becomes shorter. In order to drive (charge or discharge) one pixel within a short time, the output buffers must have sufficient driving capability. Namely, the output buffers must have a sufficient slew rate. In order to enhance the slew rate, a tail current of the conventional output buffer is increased. However, increase of the tail current results in increase of power consumption.

SUMMARY

The invention is directed to a source driver and an output buffer thereof, where during a period of driving one pixel, the output buffer is selectively overdriven, so as to increase a slew rate of an output voltage.

An embodiment of the invention provides a source driver. The source driver includes an output buffer and a feedback circuit. The output buffer includes an input stage circuit, an output stage circuit, a rising control circuit, and a falling control circuit. A first input terminal of the input stage circuit receives an input voltage of the output buffer. A second input terminal of the input stage circuit is coupled to an output terminal of the feedback circuit to receive a first feedback voltage. The input stage circuit is configured to correspondingly generate a first gate control voltage and a second gate control voltage according to the input voltage and the first feedback voltage. The output stage circuit is coupled to the input stage circuit to receive the first gate control voltage and the second gate control voltage. The output stage circuit is configured to correspondingly generate an output voltage of the output buffer to a data line of a display panel according to the first gate control voltage and the second gate control voltage. An output terminal of the output stage circuit is coupled to an input terminal of the feedback circuit. The rising control circuit is configured to compare the input voltage with the first feedback voltage to obtain a first comparison result. When the first comparison result indicates that the first feedback voltage is to be pulled up, the rising control circuit pulls down the first gate control voltage and the second gate control voltage during a first transient period. The falling control circuit is configured to compare the input voltage and the first feedback voltage to obtain a second comparison result. When the second comparison result indicates that the first feedback voltage is to be pulled down, the falling control circuit pulls up the first gate control voltage and the second gate control voltage during a second transient period. The feedback circuit is configured to generate and output the first feedback voltage related to the output voltage to the second input terminal of the input stage circuit.

An embodiment of the invention provides an output buffer including an input stage circuit, an output stage circuit, a rising control circuit, and a falling control circuit. The input stage circuit has a first input terminal and a second input terminal, the first input terminal of the input stage circuit receives an input voltage of the output buffer, and the second input terminal of the input stage circuit is configured to receive a first feedback voltage of the output buffer. The input stage circuit correspondingly generates a first gate control voltage and a second gate control voltage according to the input voltage and the first feedback voltage. The output stage circuit is coupled to the input stage circuit to receive the first gate control voltage and the second gate control voltage. The output stage circuit is configured to correspondingly generate an output voltage of the output buffer according to the first gate control voltage and the second gate control voltage. The rising control circuit is configured to compare the input voltage with the first feedback voltage to obtain a first comparison result. When the first comparison result indicates that the first feedback voltage is to be pulled up, the rising control circuit pulls down the first gate control voltage and the second gate control voltage during a first transient period. The falling control circuit is configured to compare the input voltage and the first feedback voltage to obtain a second comparison result. When the second comparison result indicates that the first feedback voltage is to be pulled down, the falling control circuit pulls up the first gate control voltage and the second gate control voltage during a second transient period.

Based on the above description, the source driver and the output buffer thereof in the embodiments of the invention are capable of comparing the input voltage with the first feedback voltage. When the comparison results indicates that the first feedback voltage is to be pulled up, the first gate control voltage and the second gate control voltage of the output stage circuit of the output buffer are pulled down to increase a slew rate of the output voltage. When the comparison results indicates that the first feedback voltage is to be pulled down, the first gate control voltage and the second gate control voltage of the output stage circuit of the output buffer are pulled up to increase the slew rate of the output voltage.

To make the aforementioned more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
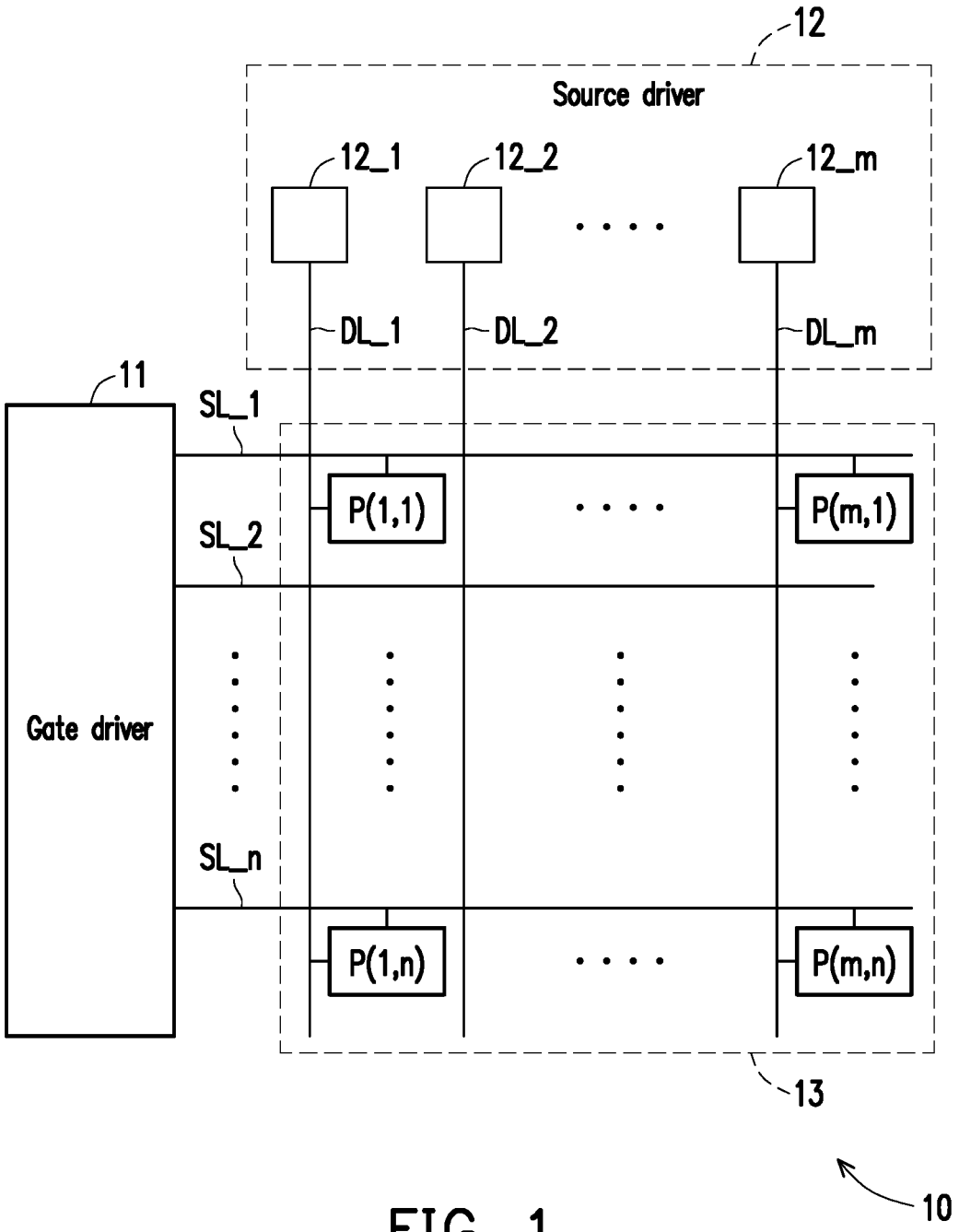
FIG. 1 is a circuit block schematic diagram of a display device according to an embodiment of the invention.

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

FIG. 1 is a circuit block schematic diagram of a display device 10 according to an embodiment of the invention. The display device 10 shown in FIG. 1 includes a gate driver 11, a source driver 12 and a display panel 13. The display panel 13 may be any type of flat panel display such as a liquid crystal display panel, an organic light-emitting diode display panel or other display panel. The display panel 13 includes a plurality of scan lines (or referred to as gate lines), a plurality of data lines (or referred to as source lines) and a plurality of pixel circuits. As shown in FIG. 1, the plurality of scan lines includes n scan lines SL_1, SL_2, . . . , SL_n, the plurality of data lines includes m data lines DL_1, DL_2, . . . , DL_m, and the plurality of pixel circuits includes m*n pixel circuits P(1,1), . . . , P(m,1), . . . , P(1,n), . . . , P(m,n), where m and n may be any integers determined according to a design requirement.

A plurality of output terminals of the gate driver 11 is coupled to different scan lines of the display panel 13 in a one-to-one manner. The gate driver 11 may scan/drive every scan line of the display panel 13. The gate driver 11 may be any type of gate driver. For example, according to a design requirement, the gate driver 11 may be a conventional gate driver or other gate driver.

The source driver 12 has a plurality of driving channel circuits, for example, m driving channel circuits 12_1, 12_2, . . . , **12_*m* shown in FIG. 1. Output terminals of the driving channel circuits 12_1-12_*m* are coupled to different data lines of the display panel 13 in the one-to-one manner. The driving channel circuits 12_1-12_*m* may convert digital pixel data into corresponding output voltages (pixel voltages), and respectively output the output voltages to the different data lines of the display panel 13. In collaboration with a scan timing of the gate driver 11, the source driver 12 may write the output voltages to corresponding pixel circuits of the display panel 13 through the data lines DL_1**-DL_m to display an image.

Figure 2:
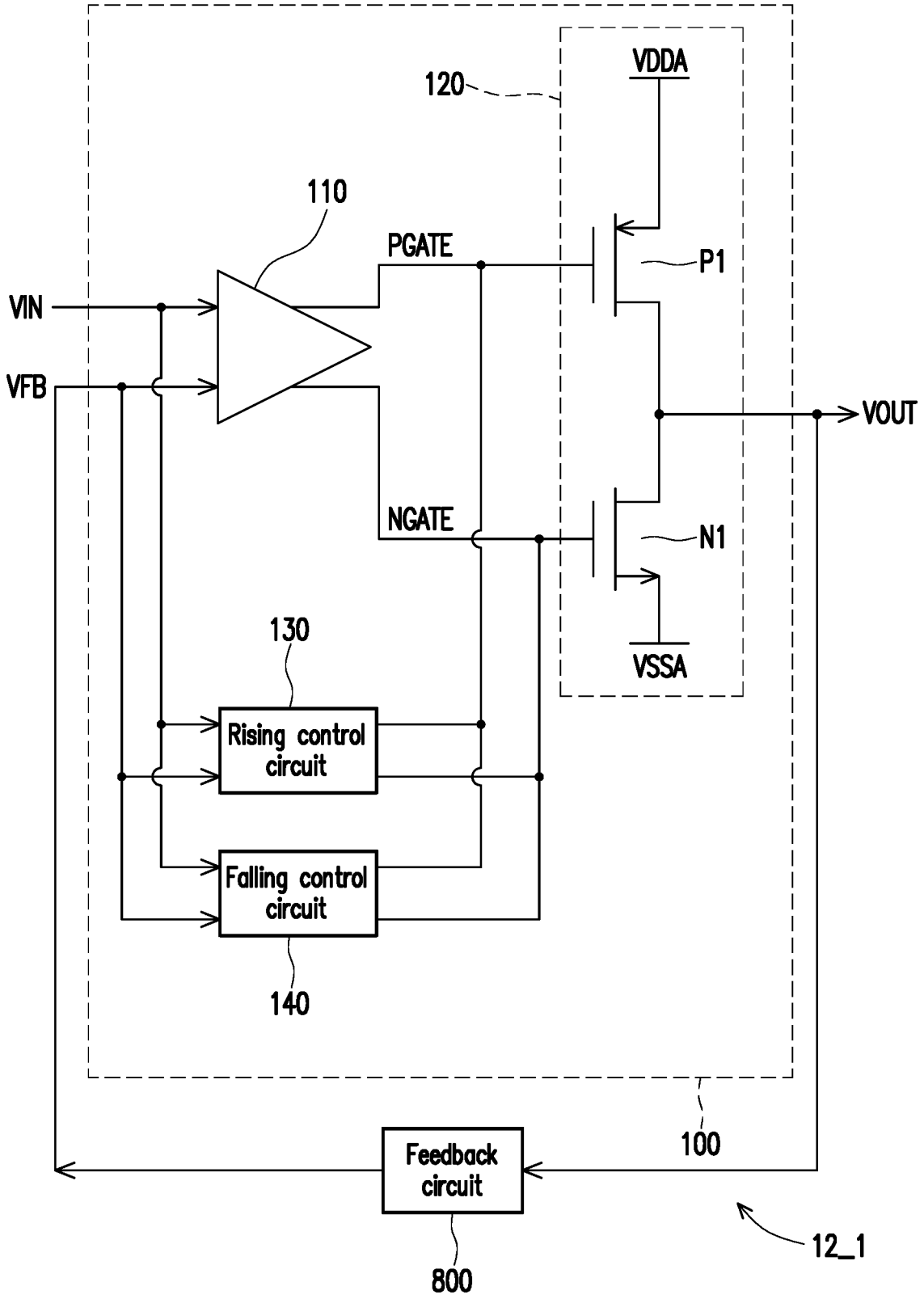
FIG. 2 is a circuit block schematic diagram of a driving channel circuit according to an embodiment of the invention.

FIG. 2 is a circuit block schematic diagram of the driving channel circuit 12_1 shown in FIG. 1 according to an embodiment of the invention. Description of other driving channel circuits 12_2-**12_*m* of FIG. 1 may be deduced according to related description of the driving channel circuit 12_1 of FIG. 2, and detail thereof is not repeated. The driving channel circuit 12_1 of FIG. 2 includes an output buffer 100 and a feedback circuit 800. A first input terminal of the output buffer 100 receives an input voltage VIN from a previous-stage circuit (not shown), and an output terminal of the output buffer 100 outputs an output voltage VOUT to a post-stage circuit (for example, the data line DL_1 of the display panel 13) and feeds back the output voltage VOUT to an input terminal of the feedback circuit 800. According to the output voltage VOUT, the feedback circuit 800 may generate and output a feedback voltage VFB related to the output voltage VOUT to a second input terminal of the output buffer 100**.

In the embodiment of FIG. 2, the output buffer includes an input stage circuit 110, an output stage circuit 120, a rising control circuit 130, and a falling control circuit 140. According to a design requirement, the input stage circuit 110 may include a differential input pair, a gain circuit and/or other input stage circuit. For example, the input stage circuit 110 may be an input stage circuit of a conventional operational amplifier or an input stage circuit and/or a gain stage circuit of other amplifier. A first input terminal of the input stage circuit 110 is coupled to the first input terminal of the output buffer 100 to receive the input voltage VIN. A second input terminal of the input stage circuit 110 is coupled to an output terminal of the feedback circuit 800 through the second input terminal of the output buffer 100 to receive the feedback voltage VFB. The input stage circuit 110 may correspondingly generate a gate control voltage PGATE and a gate control voltage NGATE according to the input voltage VIN and the feedback voltage VFB.

A first input terminal of the output stage circuit 120 is coupled to a first output terminal of the input stage circuit 110 to receive the gate control voltage PGATE. A second input terminal of the output stage circuit 120 is coupled to a second output terminal of the input stage circuit 110 to receive the gate control voltage NGATE. An output terminal of the output stage circuit 120 is coupled to the output terminal of the output buffer 100. The output stage circuit 120 may correspondingly generate the output voltage VOUT of the output buffer 100 according to the gate control voltage PGATE and the gate control voltage NGATE. In an embodiment, the output voltage VOUT may be provided to the data line DL_1 of the display panel 13. The output terminal of the output stage circuit 120 is coupled to the input terminal of the feedback circuit 800 to provide the output voltage VOUT.

In the embodiment of FIG. 2, the output stage circuit 120 includes a transistor P1 and a transistor N1. A control terminal (for example, a gate) of the transistor P1 is coupled to the first output terminal of the input stage circuit 110 to receive the gate control voltage PGATE. A first terminal (for example, a source) of the transistor P1 is coupled to a system voltage VDDA. A level of the system voltage VDDA may be determined according to an actual design requirement. A second terminal (for example, a drain) of the transistor P1 is coupled to the output terminal of the output stage circuit 120, where the output terminal of the output stage circuit 120 outputs the output voltage VOUT. A control terminal (for example, a gate) of the transistor N1 is coupled to the second output terminal of the input stage circuit 110 to receive the gate control voltage NGATE. A first terminal (for example, a source) of the transistor N1 is coupled to a reference voltage VSSA. A level of the reference voltage VSSA may be determined according to an actual design requirement. A second terminal (for example, a drain) of the transistor N1 is coupled to the output terminal of the output stage circuit 120 and the second terminal of the transistor P1.

The output stage circuit 120 shown in FIG. 2 is only an example, and in any circumstances, the implementation of the output stage circuit 120 should not be limited to the embodiment shown in FIG. 2. According to a design requirement, the output stage circuit 120 may include any type of output circuit. For example, in other embodiments, the output stage circuit 120 may be an output stage circuit of a conventional operational amplifier or an output stage circuit of other amplifier.

Figure 3:
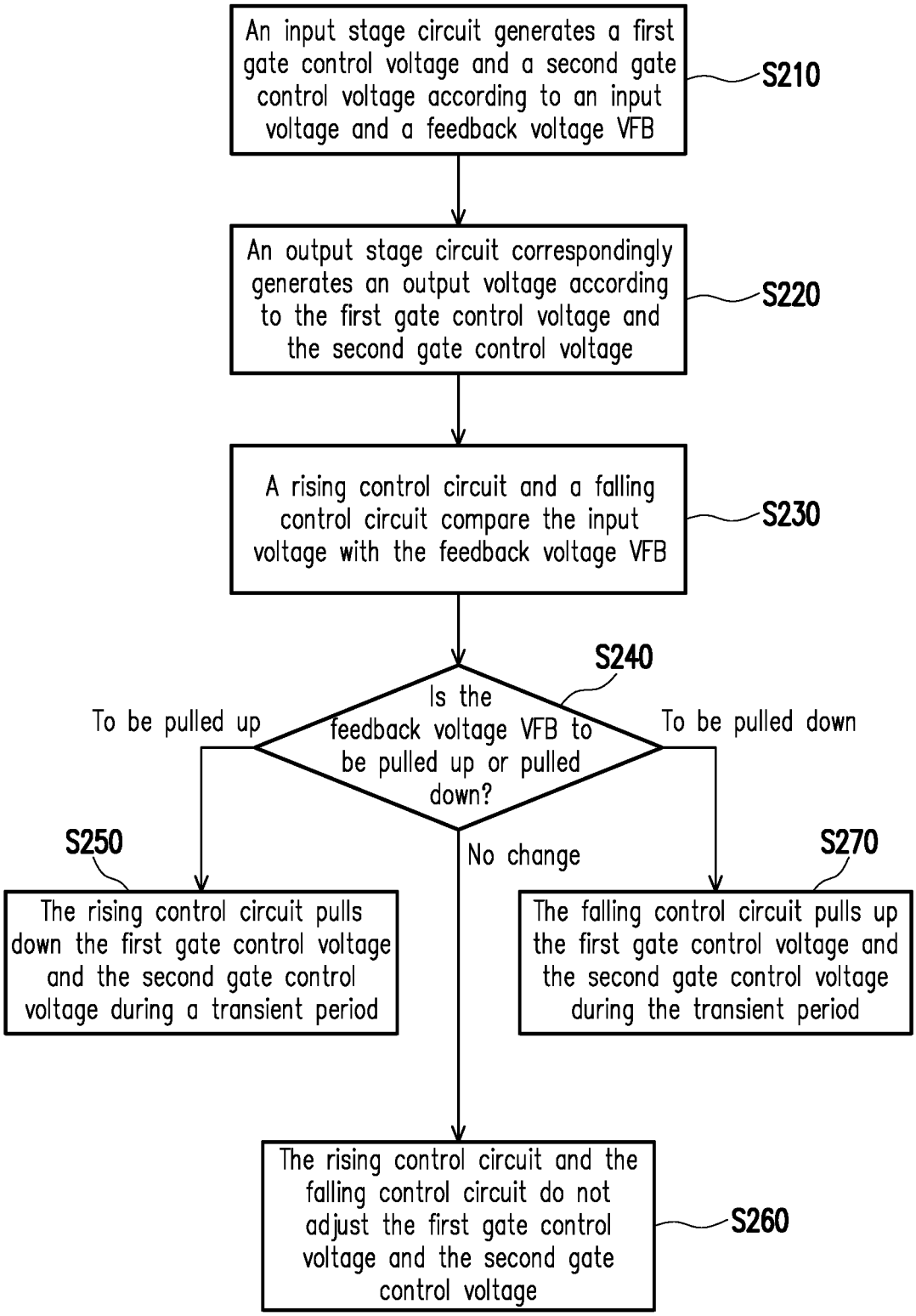
FIG. 3 is a flowchart illustrating an operation method of an output buffer according to an embodiment of the invention.

FIG. 3 is a flowchart illustrating an operation method of the output buffer according to an embodiment of the invention. Referring to FIG. 2 and FIG. 3, in a step S210, the input stage circuit 110 generates a first gate control voltage (for example, the gate control voltage PGATE) and a second gate control voltage (for example, the gate control voltage NGATE) according to the input voltage VIN of the output buffer 100 and the feedback voltage VFB. In a step S220, the output stage circuit 120 correspondingly generates the output voltage VOUT of the output buffer 100 according to the gate control voltage PGATE and the gate control voltage NGATE. In a step S230, the rising control circuit 130 compares the input voltage VIN with the feedback voltage VFB to obtain a first comparison result, and the falling control circuit 140 compares the input voltage VIN and the feedback voltage VFB to obtain a second comparison result.

When the first comparison result indicates that the feedback voltage VFB is to be pulled up ("to be pulled up" of a step S240), the rising control circuit 130 pulls down the gate control voltage PGATE and the gate control voltage NGATE during a transient period (step S250). When the rising control circuit 130 pulls down the gate control voltage NGATE, a turn off state of the transistor N1 is ensured to avoid occurrence of a short-circuit current. When the rising control circuit 130 pulls down the gate control voltage PGATE, a current flowing through the transistor P1 is temporarily increased to accelerate pulling up the output voltage VOUT. Therefore, a slew rate of the output voltage VOUT is increased.

According to a design requirement, in some embodiments, the step S250 may include a following operation. When the input voltage VIN is greater than the feedback voltage VFB, the rising control circuit 130 may pull down the gate control voltage PGATE and the gate control voltage NGATE. When the input voltage VIN is smaller than or equal to the feedback voltage VFB, the rising control circuit 130 may not adjust the gate control voltage PGATE and the gate control voltage NGATE.

When the first comparison result and the second comparison result both indicate that the feedback voltage VFB is not changed ("no change" of the step S240), the rising control circuit 130 and the falling control circuit 140 may not adjust the gate control voltage PGATE and the gate control voltage NGATE (step S260). In case that the rising control circuit 130 and the falling control circuit 140 do not interfere the gate control voltage PGATE and the gate control voltage NGATE, a level of the gate control voltage PGATE and a level of the gate control voltage NGATE are determined by the input stage circuit 110.

When the second comparison result indicates that the feedback voltage VFB is to be pulled down ("to be pulled down" of the step S240), the falling control circuit 140 pulls up the gate control voltage PGATE and the gate control voltage NGATE during the transient period (step S270). When the falling control circuit 140 pulls up the gate control voltage PGATE, a turn off state of the transistor P1 is ensured to avoid occurrence of a short-circuit current. When the falling control circuit 140 pulls up the gate control voltage NGATE, a current flowing through the transistor N1 is temporarily increased to accelerate pulling down the output voltage VOUT. Therefore, the slew rate of the output voltage VOUT is increased.

According to a design requirement, in some embodiments, the step S270 may include a following operation. When the input voltage VIN is smaller than the feedback voltage VFB, the falling control circuit 140 may pull up the gate control voltage PGATE and the gate control voltage NGATE. When the input voltage VIN is greater than or equal to the feedback voltage VFB, the falling control circuit 140 may not adjust the gate control voltage PGATE and the gate control voltage NGATE.

According to different design requirements, the block of the rising control circuit 130 and/or the falling control circuit 140 may be implemented in form of hardware, firmware, software (i.e. program) or a combination thereof. Regarding the hardware form, the block of the rising control circuit 130 and/or the falling control circuit 140 may be implemented as logic circuits on an integrated circuit. Related functions of the rising control circuit 130 and/or the falling control circuit 140 may be implemented as hardware by using hardware description languages such as Verilog HDL (VHDL) or other proper programming language. For example, the related functions of the rising control circuit 130 and/or the falling control circuit 140 may be implemented as various logic blocks, modules, and circuits in one or a plurality of controllers, a microcontroller, a microprocessor, an Application-Specific Integrated Circuit (ASIC), a Digital Signal Processor (DSP), a Field Programmable Gate Array (FPGA) and/or other processing unit.

In the embodiment of FIG. 2, the input terminal of the feedback circuit 800 is coupled to the output terminal of the output stage circuit 120 to receive the output voltage VOUT. The output terminal of the feedback circuit 800 is coupled to the second input terminal of the input stage circuit 110. The feedback circuit 800 generates and outputs the feedback voltage VFB related to the output voltage VOUT to the second input terminal of the input stage circuit 110 according to the output voltage VOUT.

Figure 4:
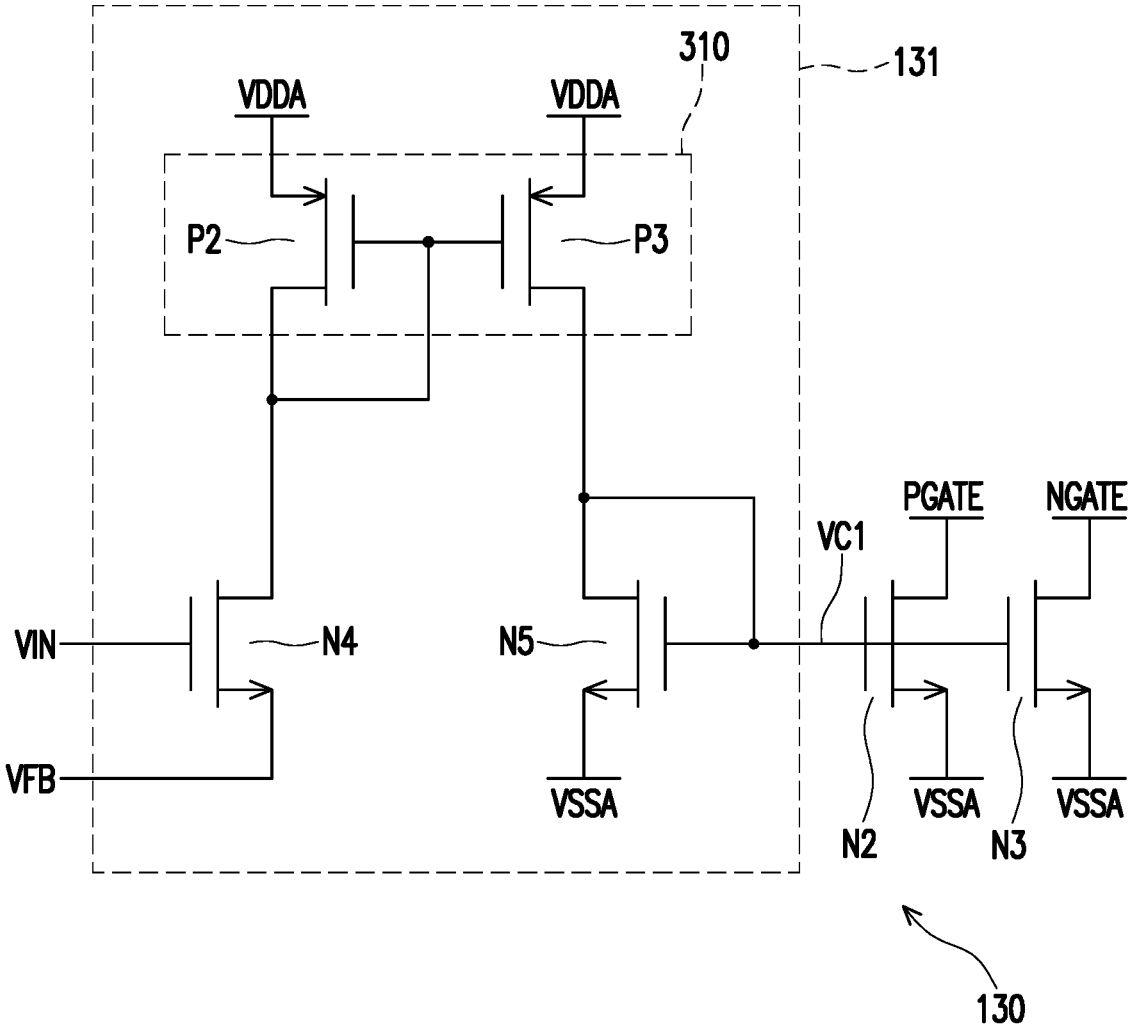
FIG. 4 is a circuit block schematic diagram of a rising control circuit shown in FIG. 2 according to an embodiment of the invention.

FIG. 4 is a circuit block schematic diagram of the rising control circuit 130 shown in FIG. 2 according to an embodiment of the invention. In the embodiment of FIG. 4, the rising control circuit 130 includes a comparing circuit 131, a transistor N2 and a transistor N3. The comparing circuit 131 may compare the input voltage VIN with the feedback voltage VFB to generate a control voltage VC1 to serve as the first comparison result. A control terminal (for example, a gate) of the transistor N2 is coupled to an output terminal of the comparing circuit 131 to receive the control voltage VC1. A first terminal (for example, a source) of the transistor N2 is coupled to the reference voltage VSSA. A second terminal (for example, a drain) of the transistor N2 is coupled to the first input terminal of the output stage circuit 120 to receive the gate control voltage PGATE. A control terminal (for example, a gate) of the transistor N3 is coupled to the output terminal of the comparing circuit 131 to receive the control voltage VC1. A first terminal (for example, a source) of the transistor N3 is coupled to the reference voltage VSSA. A second terminal (for example, a drain) of the transistor N3 is coupled to the second input terminal of the output stage circuit 120 to receive the gate control voltage NGATE.

When the input voltage VIN is greater than the feedback voltage VFB, the comparing circuit 131 may turn on the transistor N2 and the transistor N3 through the control voltage VC1 to pull down the gate control voltage PGATE and the gate control voltage NGATE. When the input voltage VIN is smaller than or equal to the feedback voltage VFB, the comparing circuit 131 may turn off the transistor N2 and the transistor N3 through the control voltage VC1, so that the rising control circuit 130 may not interfere (adjust) the gate control voltage PGATE and the gate control voltage NGATE.

In the embodiment of FIG. 4, the comparing circuit 131 includes a transistor N4, a transistor N5 and a current mirror 310. A control terminal (for example, a gate) of the transistor N4 is coupled to the input voltage VIN. A first terminal (for example, a source) of the transistor N4 is coupled to the feedback voltage VFB. A master current terminal of the current mirror 310 is coupled to a second terminal (for example, a drain) of the transistor N4. A slave current terminal of the current mirror 310 is coupled to the output terminal of the comparing circuit 131, where the output terminal of the comparing circuit 131 may provide the control voltage VC1 to the transistor N2 and the transistor N3. A control terminal (for example, a gate) of the transistor N5 is coupled to the output terminal of the comparing circuit 131. A first terminal (for example, a source) of the transistor N5 is coupled to the reference voltage VSSA. A second terminal (for example, a drain) of the transistor N5 is coupled to the slave current terminal of the current mirror 310 and the control terminal of the transistor N5.

In the embodiment of FIG. 4, the current mirror 310 includes a transistor P2 and a transistor P3. A first terminal (for example, a source) of the transistor P2 is coupled to the system voltage VDDA. A second terminal (for example, a drain) and a control terminal (for example, a gate) of the transistor P2 are coupled to the master current terminal of the current mirror 310. A first terminal (for example, a source) of the transistor P3 is coupled to the system voltage VDDA. A second terminal (for example, a drain) of the transistor P3 is coupled to the slave current terminal of the current mirror 310. A control terminal (for example, a gate) of the transistor P3 is coupled to the control terminal of the transistor P2.

Figure 5:
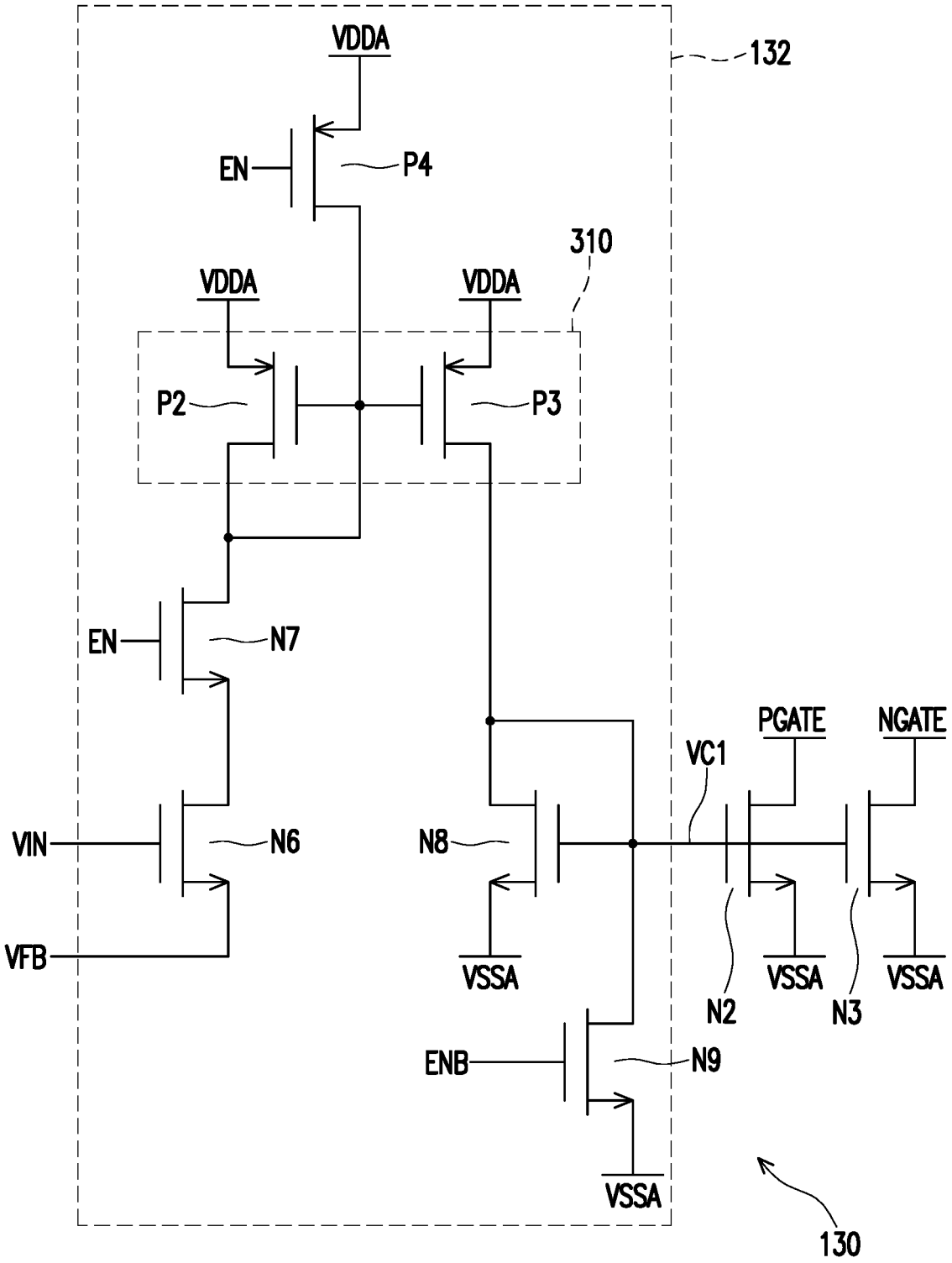
FIG. 5 is a circuit block schematic diagram of a rising control circuit of FIG. 2 according to another embodiment of the invention.

FIG. 5 is a circuit block schematic diagram of the rising control circuit 130 of FIG. 2 according to another embodiment of the invention. In the embodiment of FIG. 5, the rising control circuit 130 includes a comparing circuit 132, a transistor N2 and a transistor N3. Description of the comparing circuit 132, the transistor N2 and the transistor N3 shown in FIG. 5 may be deduced according to related description of the comparing circuit 131, the transistor N2 and the transistor N3 shown in FIG. 4, and detail thereof is not repeated.

In the embodiment of FIG. 5, the comparing circuit 132 includes a transistor N6, a transistor N7, a transistor N8, a transistor N9, a transistor P4 and a current mirror 310. A control terminal (for example, a gate) of the transistor N6 is coupled to the input voltage VIN. A first terminal (for example, a source) of the transistor N6 is coupled to the feedback voltage VFB. A control terminal (for example, a gate) of the transistor N7 is controlled by a control signal EN. A first terminal (for example, a source) of the transistor N7 is coupled to a second terminal (for example, a drain) of the transistor N6.

A master current terminal of the current mirror 310 is coupled to a second terminal (for example, a drain) of the transistor N7. A slave current terminal of the current mirror 310 is coupled to the output terminal of the comparing circuit 132, where the output terminal of the comparing circuit 132 may provide the control voltage VC1 to the transistor N2 and the transistor N3. Description of the current mirror 310 of FIG. 5 may be deduced according to related description of the current mirror 310 of FIG. 4, and detail thereof is not repeated.

A control terminal (for example, a gate) of the transistor P4 is controlled by the control signal EN. A first terminal (for example, a source) of the transistor P4 is coupled to the system voltage VDDA. A second terminal (for example, a drain) of the transistor P4 is coupled to an enabling terminal of the current mirror 310. Namely, the second terminal of the transistor P4 is coupled to the control terminal of the transistor P2 and the control terminal of the transistor P3. A control terminal (for example, a gate) of the transistor N8 is coupled to the output terminal of the comparing circuit 132. A first terminal (for example, a source) of the transistor N8 is coupled to the reference voltage VSSA. A second terminal (for example, a drain) of the transistor N8 is coupled to the slave current terminal of the current mirror 310 and the control terminal of the transistor N8. A control terminal (for example, a gate) of the transistor N9 is controlled by a control signal ENB, where the control signal ENB is an inverted signal of the control signal EN. A first terminal (for example, a source) of the transistor N9 is coupled to the reference voltage VSSA. A second terminal (for example, a drain) of the transistor N9 is coupled to the control terminal of the transistor N8.

When the control signal EN is at a high voltage level (for example, a level of the system voltage VDDA or other level), i.e. when the control signal ENB has a low voltage level (for example, a level of the reference voltage VSSA or other level), the transistor N7 is turned on, and the transistor P4 and the transistor N9 are turned off, and now the operation of the comparing circuit 132 of FIG. 5 is similar to the operation of the comparing circuit 131 of FIG. 4. When the control signal EN is at the low voltage level (i.e. the control signal ENB is at the high voltage level), the transistor N7 is turned off, and the transistor P4 and the transistor N9 are turned on, and now the comparing circuit 132 of FIG. 5 is disabled, and the control voltage VC1 is pulled down to the low voltage level. When the control voltage VC1 is pulled down to the low voltage level, the transistor N2 and the transistor N3 are turned off. Therefore, when the control signal EN (the control signal ENB) disables the rising control circuit 130, the rising control circuit 130 may not interfere (adjust) the gate control voltage PGATE and the gate control voltage NGATE.

In some application situations, after the feedback voltage VFB is pulled down, the feedback voltage VFB is probably lower (smaller) than the input voltage VIN within a specific period, and after the specific period is ended, the level of the feedback voltage VFB is returned to be consistent with the input voltage VIN. Generally, the specific period is very short. Through the control of the control signal EN (the control signal ENB), the rising control circuit 130 may be disabled within the specific period and enabled outside the specific period. Therefore, wrong operation of the rising control circuit 130 in the specific period may be avoided.

Figure 6:
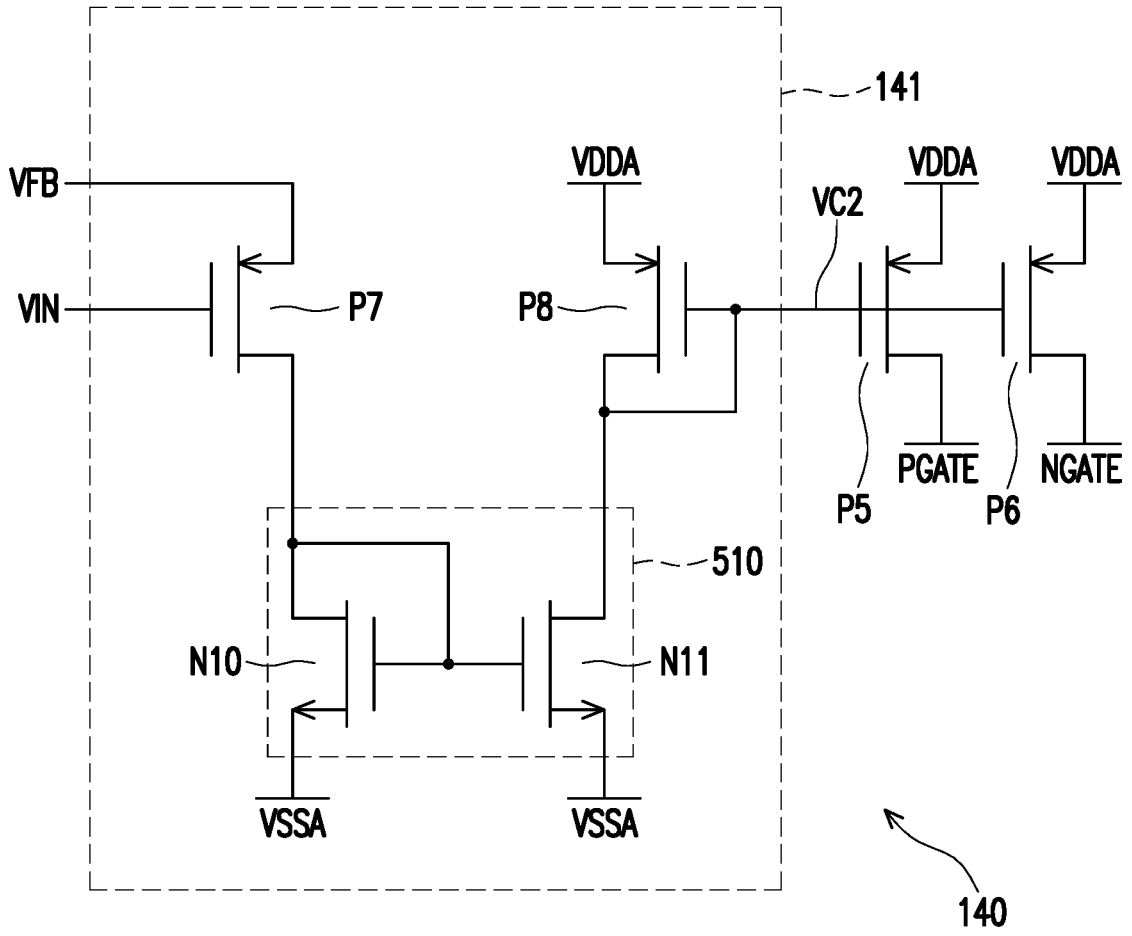
FIG. 6 is a circuit block schematic diagram of a falling control circuit shown in FIG. 2 according to an embodiment of the invention.

FIG. 6 is a circuit block schematic diagram of the falling control circuit 140 shown in FIG. 2 according to an embodiment of the invention. In the embodiment of FIG. 6, the falling control circuit 140 includes a comparing circuit 141, a transistor P5 and a transistor P6. The comparing circuit 141 may compare the input voltage VIN with the feedback voltage VFB to generate a control voltage VC2 to serve as the second comparison result. A control terminal (for example, a gate) of the transistor P5 is coupled to an output terminal of the comparing circuit 141 to receive the control voltage VC2. A first terminal (for example, a source) of the transistor P5 is coupled to the system voltage VDDA. A second terminal (for example, a drain) of the transistor P5 is coupled to the first input terminal of the output stage circuit 120 to receive the gate control voltage PGATE. A control terminal (for example, a gate) of the transistor P6 is coupled to the output terminal of the comparing circuit 141 to receive the control voltage VC2. A first terminal (for example, a source) of the transistor P6 is coupled to the system voltage VDDA. A second terminal (for example, a drain) of the transistor P6 is coupled to the second input terminal of the output stage circuit 120 to receive the gate control voltage NGATE.

When the input voltage VIN is smaller than the feedback voltage VFB, the comparing circuit 141 may turn on the transistor P5 and the transistor P6 through the control voltage VC2 to pull up the gate control voltage PGATE and the gate control voltage NGATE. When the input voltage VIN is greater than or equal to the feedback voltage VFB, the comparing circuit 141 may turn off the transistor P5 and the transistor P6 through the control voltage VC2, so that the falling control circuit 140 may not interfere (adjust) the gate control voltage PGATE and the gate control voltage NGATE.

In the embodiment of FIG. 6, the comparing circuit 141 includes a transistor P7, a transistor P8 and a current mirror 510. A control terminal (for example, a gate) of the transistor P7 is coupled to the input voltage VIN. A first terminal (for example, a source) of the transistor P7 is coupled to the feedback voltage VFB. A master current terminal of the current mirror 510 is coupled to a second terminal (for example, a drain) of the transistor P7. A slave current terminal of the current mirror 510 is coupled to the output terminal of the comparing circuit 141, where the output terminal of the comparing circuit 141 may provide the control voltage VC2 to the transistor P5 and the transistor P6. A control terminal (for example, a gate) of the transistor P8 is coupled to the output terminal of the comparing circuit 141. A first terminal (for example, a source) of the transistor P8 is coupled to the system voltage VDDA. A second terminal (for example, a drain) of the transistor P8 is coupled to the slave current terminal of the current mirror 510 and the control terminal of the transistor P8.

In the embodiment of FIG. 6, the current mirror 510 includes a transistor N10 and a transistor N11. A first terminal (for example, a source) of the transistor N10 is coupled to the reference voltage VSSA. A second terminal (for example, a drain) and a control terminal (for example, a gate) of the transistor N10 are coupled to the master current terminal of the current mirror 510. A first terminal (for example, a source) of the transistor N11 is coupled to the reference voltage VSSA. A second terminal (for example, a drain) of the transistor N11 is coupled to the slave current terminal of the current mirror 510. A control terminal (for example, a gate) of the transistor N11 is coupled to the control terminal of the transistor N10.

Figure 7:
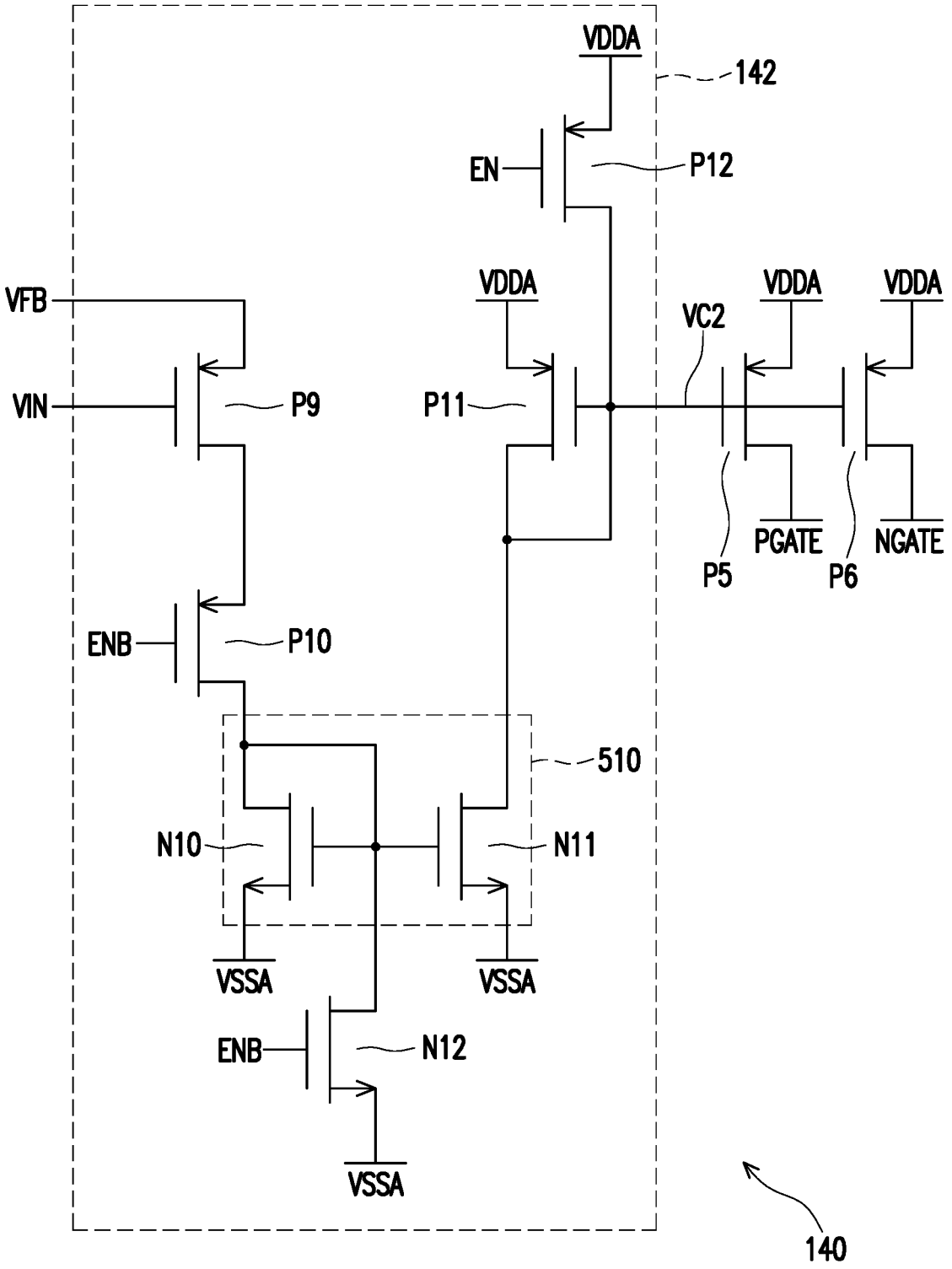
FIG. 7 is a circuit block schematic diagram of a falling control circuit of FIG. 2 according to another embodiment of the invention.

FIG. 7 is a circuit block schematic diagram of the falling control circuit 140 of FIG. 2 according to another embodiment of the invention. In the embodiment of FIG. 7, the falling control circuit 140 includes a comparing circuit 142, a transistor P5 and a transistor P6. Description of the comparing circuit 142, the transistor P5 and the transistor P6 shown in FIG. 7 may be deduced according to related description of the comparing circuit 141, the transistor P5 and the transistor P6 shown in FIG. 6, and detail thereof is not repeated.

In the embodiment of FIG. 7, the comparing circuit 142 includes a transistor P9, a transistor P10, a transistor P11, a transistor P12, a transistor N12 and a current mirror 510. A control terminal (for example, a gate) of the transistor P9 is coupled to the input voltage VIN. A first terminal (for example, a source) of the transistor P9 is coupled to the feedback voltage VFB. A control terminal (for example, a gate) of the transistor P10 is controlled by the control signal ENB. A first terminal (for example, a source) of the transistor P10 is coupled to a second terminal (for example, a drain) of the transistor P9.

A master current terminal of the current mirror 510 is coupled to a second terminal (for example, a drain) of the transistor P10. A slave current terminal of the current mirror 510 is coupled to the output terminal of the comparing circuit 142, where the output terminal of the comparing circuit 142 may provide the control voltage VC2 to the transistor P5 and the transistor P6. Description of the current mirror 510 of FIG. 7 may be deduced according to related description of the current mirror 510 of FIG. 6, and detail thereof is not repeated.

A control terminal (for example, a gate) of the transistor N12 is controlled by the control signal ENB. A first terminal (for example, a source) of the transistor N12 is coupled to the reference voltage VSSA. A second terminal (for example, a drain) of the transistor N12 is coupled to an enabling terminal of the current mirror 510. Namely, the second terminal of the transistor N12 is coupled to the control terminal of the transistor N10 and the control terminal of the transistor N11. A control terminal (for example, a gate) of the transistor P11 is coupled to the output terminal of the comparing circuit 142. A first terminal (for example, a source) of the transistor P11 is coupled to the system voltage VDDA. A second terminal (for example, a drain) of the transistor P11 is coupled to the slave current terminal of the current mirror 510 and the control terminal of the transistor P11. A control terminal (for example, a gate) of the transistor P12 is controlled by the control signal EN, where the control signal EN is an inverted signal of the control signal ENB. A first terminal (for example, a source) of the transistor P12 is coupled to the system voltage VDDA. A second terminal (for example, a drain) of the transistor P12 is coupled to the control terminal of the transistor P11.

When the control signal EN is at a high voltage level (for example, a level of the system voltage VDDA or other level), i.e. when the control signal ENB is at a low voltage level (for example, a level of the reference voltage VSSA or other level), the transistor P10 is turned on, and the transistor N12 and the transistor P12 are turned off, and now the operation of the comparing circuit 142 of FIG. 7 is similar to the operation of the comparing circuit 141 of FIG. 6. When the control signal EN is at the low voltage level (i.e. the control signal ENB is at the high voltage level), the transistor P10 is turned off, and the transistor N12 and the transistor P12 are turned on, and now the comparing circuit 142 of FIG. 7 is disabled, and the control voltage VC2 is pulled up to the high voltage level. When the control voltage VC2 is pulled up to the high voltage level, the transistor P5 and the transistor P6 are turned off. Therefore, when the control signal EN (the control signal ENB) disables the falling control circuit 140, the falling control circuit 140 may not interfere (adjust) the gate control voltage PGATE and the gate control voltage NGATE.

In some application situations, after the feedback voltage VFB is pulled up, the feedback voltage VFB is probably higher (greater) than the input voltage VIN within a specific period, and after the specific period is ended, the level of the feedback voltage VFB is returned to be consistent with the input voltage VIN. Generally, the specific period is very short. Through the control of the control signal EN (the control signal ENB), the falling control circuit 140 may be disabled within the specific period and enabled outside the specific period. Therefore, wrong operation of the falling control circuit 140 in the specific period may be avoided.

Figure 8:
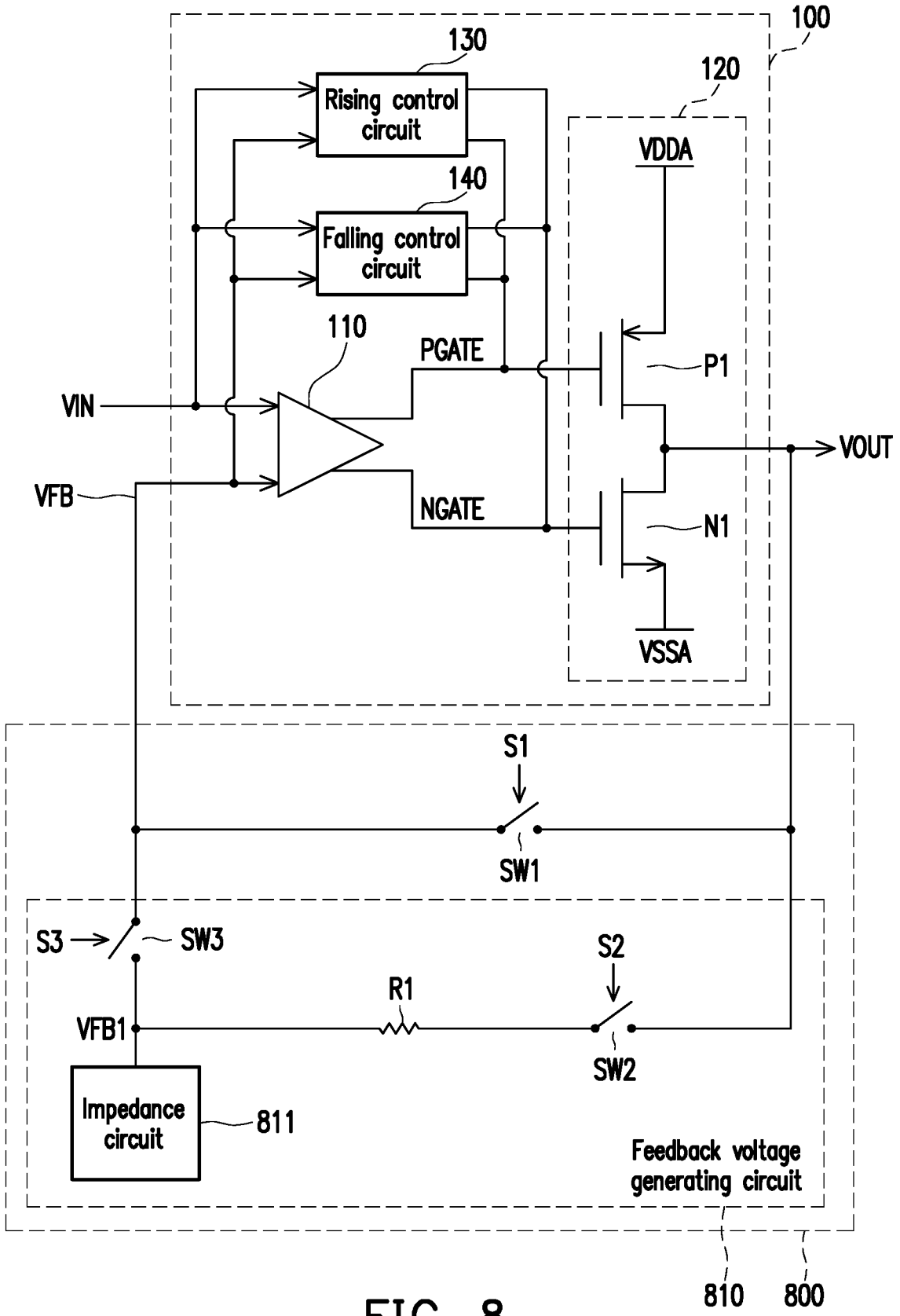
FIG. 8 is a circuit block schematic diagram of a source driver according to another embodiment of the invention.

FIG. 8 is a circuit block schematic diagram of the feedback circuit 800 of FIG. 2 according to an embodiment of the invention. In the embodiment of FIG. 8, the feedback circuit 800 includes a feedback switch SW1 and a feedback voltage generating circuit 810. A first terminal of the feedback switch SW1 is coupled to the second input terminal of the input stage circuit 110 of the output buffer 100. A second terminal of the feedback switch SW1 is coupled to the output terminal of the output stage circuit 120 of the output buffer 100. The feedback switch SW1 is controlled by a control signal S1. The feedback switch SW1 is turned off during an overdriving period, and is turned on during a normal driving period. When the feedback switch SW1 is turned on, the output buffer 100 is equivalent to a unit gain buffer. Now, the output voltage VOUT is used as the feedback voltage VFB and fed back to the second input terminal of the input stage circuit 110 of the output buffer 100. Therefore, the output voltage VOUT may follow the input voltage VIN.

An output terminal of the feedback voltage generating circuit 810 is coupled to the second input terminal of the input stage circuit 110 of the output buffer 100. An input terminal of the feedback voltage generating circuit 810 is coupled to the output terminal of the output stage circuit 120 of the output buffer 100 to receive the output voltage VOUT. During the overdriving period, the feedback voltage generating circuit 810 may generate and output the feedback voltage VFB related to the output voltage VOUT to the second input terminal of the input stage circuit 110 of the output buffer 100. When the input voltage VIN is under a "rising mode", the feedback voltage VFB is lower than the output voltage VOUT. When the input voltage VIN is under a "falling mode", the feedback voltage VFB is higher than the output voltage VOUT. Therefore, the output buffer 100 may be overdriven during the overdriving period, so as to increase the slew rate of the output voltage VOUT. During the normal driving period, the feedback voltage generating circuit 810 may not output the feedback voltage VFB to the second input terminal of the output buffer 100. Namely, the feedback voltage generating circuit 810 may not interfere the second input terminal of the output buffer 100 during the normal driving period.

In the embodiment of FIG. 8, the feedback voltage generating circuit 810 includes a switch SW2, a switch SW3, a voltage dividing resistor R1 and an impedance circuit 811. The switch SW2 is controlled by a control signal S2, and the switch SW3 is controlled by a control signal S3. During the overdriving period, the switch SW2 and the switch SW3 are turned on. During the normal driving period, the switch SW2 and the switch SW3 are turned off. A first terminal of the switch SW2 is coupled to the output terminal of the output stage circuit 120 of the output buffer 100. A first terminal of the switch SW3 is coupled to the second input terminal of the input stage circuit 110 of the output buffer 100.

A first terminal of the voltage dividing resistor R1 is coupled to a second terminal of the switch SW2. A second terminal of the voltage dividing resistor R1 is coupled to a second terminal of the switch SW3. The impedance circuit 811 is coupled to the second terminal of the voltage dividing resistor R1 to provide impedance. The voltage dividing resistor R1 and the impedance circuit 811 may implement a voltage dividing operation to generate a feedback voltage VFB1 related to the output voltage VOUT. When the switch SW3 is turned on, the feedback voltage VFB1 is transmitted to the second input terminal of the input stage circuit 110 to serve as the feedback voltage VFB. When the switch SW3 is turned off, the feedback voltage generating circuit 810 may not interfere the second input terminal of the input stage circuit 110.

Figure 9:
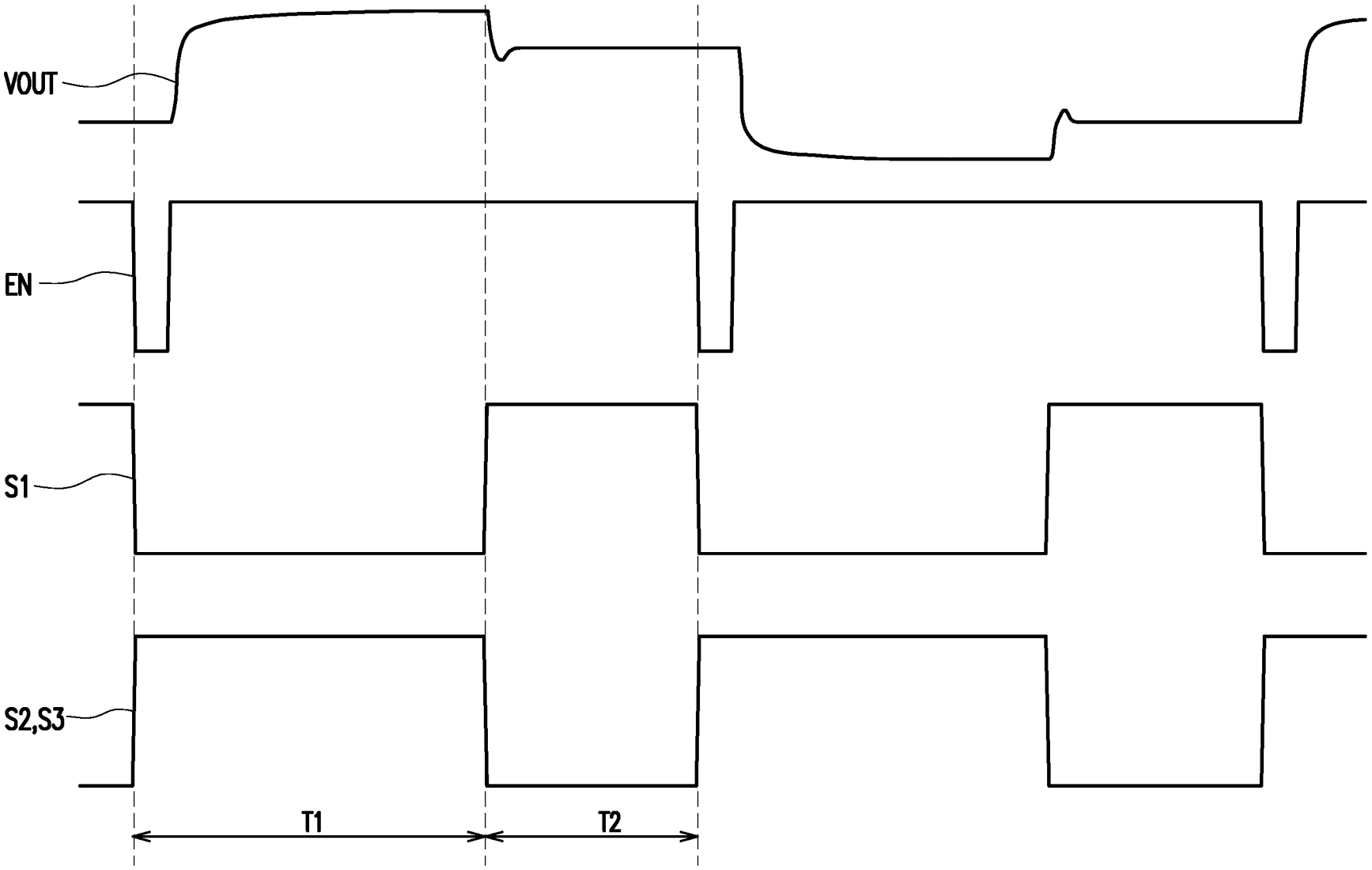
FIG. 9 is a timing schematic diagram of a source driver according to another embodiment of the invention.

FIG. 9 is a timing schematic diagram of a source driver according to another embodiment of the invention. A horizontal axis of FIG. 9 represents time, and a vertical axis thereof represents signal levels. Referring to FIG. 5, FIG. 7, FIG. 8 and FIG. 9 at the same time, when the input voltage VIN is under the rising mode, the impedance circuit 811 outputs the feedback voltage VFB1 lower than the output voltage VOUT. During the overdriving period T1, the control signal S2 and the control signal S3 are at a high logic level, and the control signal S1 is at a low logic level, so that the switch SW2 and the switch SW3 are turned on, and the switch SW1 is not turned on, and the feedback voltage VFB1 lower than the output voltage VOUT is provided to the second input terminal of the input stage circuit 110 of the output buffer 100 through the switch SW3. Therefore, during the overdriving period T1, the output voltage VOUT may be higher than a target level. When the input voltage VIN is under the falling mode, the impedance circuit 811 outputs the feedback circuit VFB1 higher than the output voltage VOUT. Namely, the feedback voltage VFB1 higher than the output voltage VOUT is provided to the second input terminal of the input stage circuit 110 of the output buffer 100 through the switch SW3 during the overdriving period T1 (and now the feedback switch SW1 is turned off). Therefore, the output voltage VOUT may be lower than the target level during the overdriving period.

During the normal driving period T2, the control signal S2 and the control signal S2 are at the low logic level, and the control signal S1 is at the high logic level, so that the switch SW2 and the switch SW3 are turned off, the switch SW1 is turned on, and the feedback voltage VFB1 is not provided to the second input terminal of the input stage circuit 110 of the output buffer 100. Therefore, during the normal driving period T2, the output voltage VOUT may be recovered to the target level (for example, the level of the input voltage VIN). Operating timing of the control signal EN to the rising control circuit 130 and the falling control circuit 140 has been described in the embodiment of FIG. 5 and FIG. 7, which is not repeated.

Figure 10:
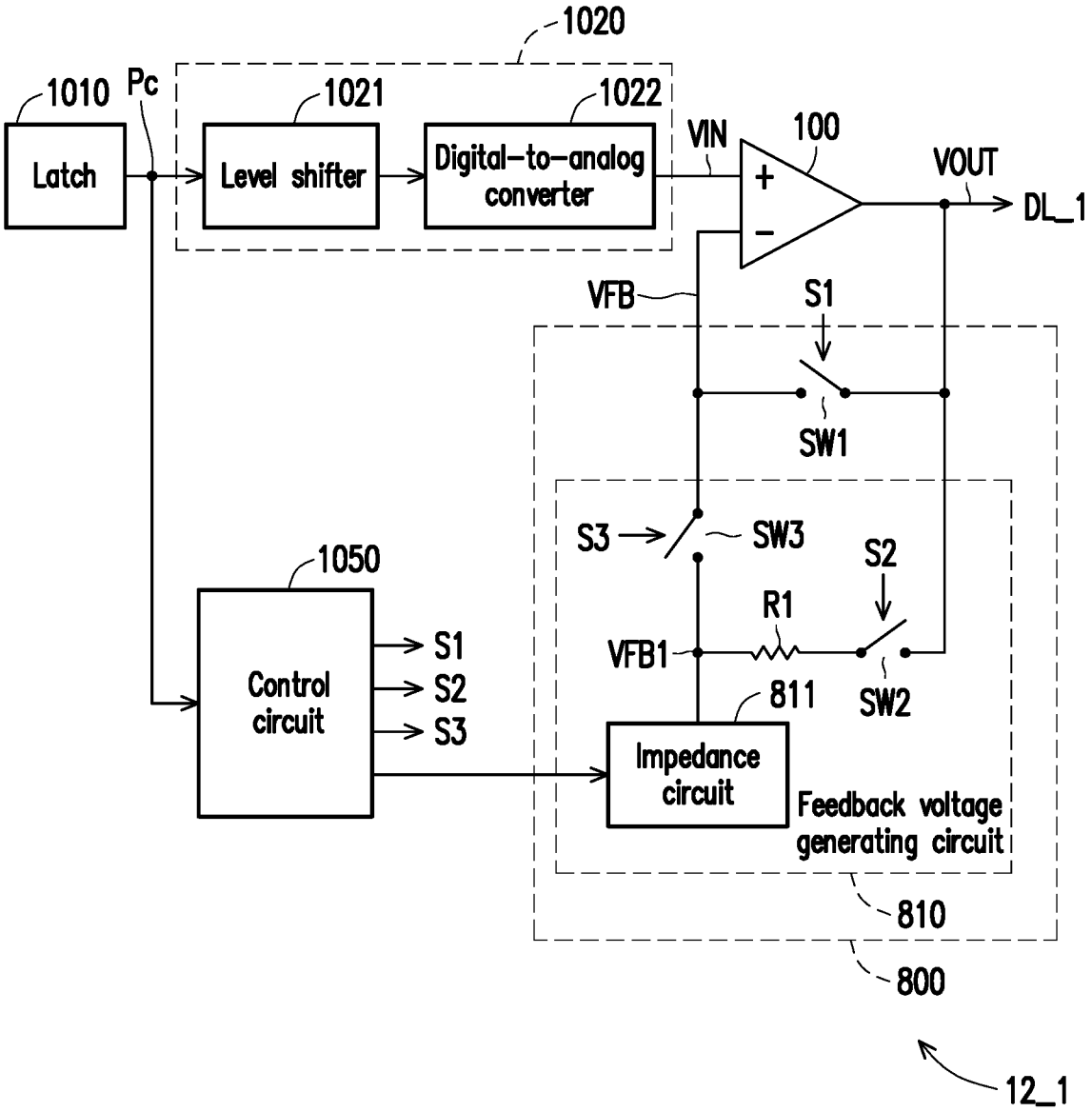
FIG. 10 is a circuit block schematic diagram of a driving channel circuit of FIG. 1 according to another embodiment of the invention.

FIG. 10 is a circuit block schematic diagram of the driving channel circuit 12_1 of FIG. 1 according to another embodiment of the invention. Description of the other driving channel circuits **12_2-12_*m* shown in FIG. 1 may refer to related description of the driving channel circuit 12_1 of FIG. 10, and detail thereof is not repeated. The driving channel circuit 12_1 of FIG. 10 includes a latch 1010, a conversion circuit 1020, the output buffer 100 and the feedback circuit 800. The latch 1010 may provide current pixel data Pc to the conversion circuit 1020. The latch 1010 may be any type of latch. For example, according to a design requirement, the latch 1010** may be a conventional line latch or other latch.

The conversion circuit 1020 may convert the current pixel data Pc into an analog voltage (which is referred to as the input voltage VIN hereinafter), and output the input voltage VIN to the output buffer 100. In the embodiment of FIG. 10, the conversion circuit 1020 may include a level shifter 1021 and a Digital-to-Analog Converter (DAC) 1022. The level shifter 1021 may increase a voltage swing of the current pixel data Pc, and the DAC 1022 may convert the current pixel data Pc into the input voltage VIN. The DAC 1022 may output the input voltage VIN to the output buffer 100. In other embodiments, the level shifter 1021 may be omitted according to a design requirement, such that the DAC 1022 may directly receive the current pixel data Pc.

Description of the output buffer 100 shown in FIG. 10 may refer to related description of FIG. 2 to FIG. 9, and detail thereof is not repeated. A first input terminal (for example, a non-inverted input terminal) of the output buffer 100 is coupled to an output terminal of the DAC 1022 to receive the input voltage VIN. The output terminal of the output buffer 100 may generate the output voltage VOUT to the data line DL_1 of the display panel 13 and the input terminal of the feedback circuit 800. According to the output voltage VOUT, the feedback circuit 800 may generate and output the feedback voltage VFB related to the output voltage VOUT to a second input terminal (for example, an inverted input terminal) of the output buffer 100. Description of the feedback circuit 800 shown in FIG. 10 may be deduced by referring to related description of FIG. 2 to FIG. 9, and detail thereof is not repeated.

According to a requirement of an application environment, the control circuit 1050 may selectively divide one scan line period (a turn on period of one pixel circuit) into an overdriving period and a normal driving period. Based on control of the control circuit 1050 on the feedback switch SW1 and the feedback voltage generating circuit 810, the output buffer 100 may perform overdriving to the data line DL_1 during the overdriving period, and perform normal driving to the data line DL_1 during the normal driving period. The output buffer 100 may perform overdriving to the data line DL_1 of the display panel 13 during the overdriving period to increase the slew rate of the output voltage VOUT. Therefore, internal electrical parameters of the output buffer 100 such as a tail current, etc., are unnecessary to be adjusted/changed in order to increase the slew rate.

According to the requirement of the application environment, the control circuit 1050 may also selectively take a whole scan line period (a turn on period of one pixel circuit) as the normal driving period. Namely, the overdriving operation performed to the data line DL_1 by the output buffer 100 may be selectively disabled.

A time length of the overdriving period may be selectively set according to the requirement of the application environment. In the embodiment of FIG. 1, the data line DL_1 is coupled to a near pixel circuit (for example, a pixel circuit P(1,1)) and a far pixel circuit (for example, a pixel circuit P(1,n)) of the display panel 13. A distance between the near pixel circuit and the source driver 12 is smaller than a distance between the far pixel circuit and the source driver 12. Generally, a time constant of the far pixel circuit is greater than a time constant of the near pixel circuit. Based on a design requirement, the control circuit 1050 may dynamically adjust a time length of the overdriving period according to a position (the distance between the pixel circuit and the source driver) of the pixel circuit in the display panel 13. For example, a time length of the overdriving period related to the near pixel circuit is smaller than a time length of the overdriving period related to the far pixel circuit.

The feedback switch SW1 is controlled by the control signal S1 of the control circuit 1050. The control circuit 1050 turns off the feedback switch SW1 during the overdriving period, and turns on the feedback switch SW1 during the normal driving period. When the feedback switch SW1 is turned on, the output voltage VOUT is used as the feedback voltage VFB and fed back to the second input terminal of the output buffer 100. Therefore, the output voltage VOUT may follow the input voltage VIN.

During the overdriving period, the feedback voltage generating circuit 810 may generate and output the feedback voltage VFB related to the output voltage VOUT to the second input terminal of the output buffer 100. When the input voltage VIN is under the "rising mode", the feedback voltage VFB is lower than the output voltage VOUT. When the input voltage VIN is under the "falling mode", the feedback voltage VFB is higher than the output voltage VOUT. Therefore, the output buffer 100 may perform overdriving to the data line DL_1 of the display panel 13 during the overdriving period, so as to increase the slew rate of the output voltage VOUT. During the normal driving period, the feedback voltage generating circuit 810 may not output the feedback voltage VFB1 to the second input terminal of the output buffer 100. Namely, the feedback voltage generating circuit 810 may not interfere the second input terminal of the output buffer 100 during the normal driving period.

In the embodiment of FIG. 10, "the input voltage VIN is under the rising mode" may be defined as "the input voltage VIN corresponding to the current pixel data Pc is greater than the input voltage VIN corresponding to the previous pixel data", and "the input voltage VIN is under the falling mode" may be defined as "the input voltage VIN corresponding to the current pixel data Pc is smaller than the input voltage VIN corresponding to the previous pixel data". The previous pixel data may be regarded as the current pixel data Pc in a previous scan line period. Comparatively, the current pixel data Pc is pixel data in the current scan line period. The control circuit 1050 may check the current pixel data Pc and the previous pixel data to determine whether the input voltage VIN is to be pulled up or pulled down.

When the current pixel data Pc is greater than the previous pixel data and the driving channel circuit 12_1 is operated in positive polarity, the control circuit 1050 may determine that "the input voltage VIN is to be pulled up". Alternatively, when the current pixel data Pc is smaller than the previous pixel data and the driving channel circuit 12_1 is operated in negative polarity, the control circuit 1050 may determine that "the input voltage VIN is to be pulled up". Namely, the input voltage VIN is under the rising mode. When the input voltage VIN is under the rising mode, the control circuit 1050 controls the feedback voltage generating circuit 810, such that the feedback voltage VFB1 is lower than the output voltage VOUT. The feedback voltage VFB1 is provided to the second input terminal of the output buffer 100 to serve as the feedback voltage VFB during the overdriving period (now the feedback switch SW1 is turned off). Therefore, the output voltage VOUT may be higher than a target level during the overdriving period. The target level may be complied with the level of the input voltage VIN. The feedback voltage VFB1 is not provided to the second input terminal of the output buffer 100 during the normal driving period (now the feedback switch SW1 is turned on). Therefore, the output voltage VOUT may be recovered back to the target level (for example, the level of the input voltage VIN) during the normal driving period.

When the current pixel data Pc is smaller than the previous pixel data and the driving channel circuit 12_1 is operated in the positive polarity, the control circuit 1050 may determine that "the input voltage VIN is to be pulled down". Alternatively, when the current pixel data Pc is greater than the previous pixel data and the driving channel circuit 12_1 is operated in negative polarity, the control circuit 1050 may determine that "the input voltage VIN is to be pulled down". Namely, the input voltage VIN is under the falling mode. When the input voltage VIN is under the falling mode, the control circuit 1050 controls the feedback voltage generating circuit 810, such that the feedback voltage VFB1 is higher than the output voltage VOUT. The feedback voltage VFB1 is provided to the second input terminal of the output buffer 100 to serve as the feedback voltage VFB during the overdriving period (now the feedback switch SW1 is turned off). Therefore, the output voltage VOUT may be lower than the target level during the overdriving period. The target level may be complied with the level of the input voltage VIN. The feedback voltage VFB1 is not provided to the second input terminal of the output buffer 100 during the normal driving period (now the feedback switch SW1 is turned on). Therefore, the output voltage VOUT may be recovered back to the target level (for example, the level of the input voltage VIN) during the normal driving period.

In another embodiments, according to different design requirements, "the input voltage VIN is under the rising mode" may be defined as "the input voltage VIN corresponding to the current pixel data Pc is smaller than the input voltage VIN corresponding to the previous pixel data", and "the input voltage VIN is under the falling mode" may be defined as "the input voltage VIN corresponding to the current pixel data Pc is greater than the input voltage VIN corresponding to the previous pixel data". The previous pixel data may be regarded as the current pixel data Pc in a previous scan line period. Comparatively, the current pixel data Pc is pixel data in the current scan line period. The control circuit 1050 may check the current pixel data Pc and the previous pixel data to determine whether the input voltage VIN is to be pulled up or pulled down.

In another embodiments, when the current pixel data Pc is smaller than the previous pixel data and the driving channel circuit 12_1 is operated in positive polarity, the control circuit 1050 may determine that "the input voltage VIN is to be pulled up". Alternatively, when the current pixel data Pc is greater than the previous pixel data and the driving channel circuit 12_1 is operated in negative polarity, the control circuit 1050 may determine that "the input voltage VIN is to be pulled up". Namely, the input voltage VIN is under the rising mode. When the input voltage VIN is under the rising mode, the control circuit 1050 controls the feedback voltage generating circuit 810, such that the feedback voltage VFB1 is lower than the output voltage VOUT. The feedback voltage VFB1 is provided to the second input terminal of the output buffer 100 to serve as the feedback voltage VFB during the overdriving period (now the feedback switch SW1 is turned off). Therefore, the output voltage VOUT may be higher than a target level during the overdriving period. The target level may be complied with the level of the input voltage VIN. The feedback voltage VFB1 is not provided to the second input terminal of the output buffer 100 during the normal driving period (now the feedback switch SW1 is turned on). Therefore, the output voltage VOUT may be recovered back to the target level (for example, the level of the input voltage VIN) during the normal driving period.

In another embodiments, when the current pixel data Pc is greater than the previous pixel data and the driving channel circuit 12_1 is operated in the positive polarity, the control circuit 1050 may determine that "the input voltage VIN is to be pulled down". Alternatively, when the current pixel data Pc is smaller than the previous pixel data and the driving channel circuit 12_1 is operated in negative polarity, the control circuit 1050 may determine that "the input voltage VIN is to be pulled down". Namely, the input voltage VIN is under the falling mode. When the input voltage VIN is under the falling mode, the control circuit 1050 controls the feedback voltage generating circuit 810, such that the feedback voltage VFB1 is higher than the output voltage VOUT. The feedback voltage VFB1 is provided to the second input terminal of the output buffer 100 to serve as the feedback voltage VFB during the overdriving period (now the feedback switch SW1 is turned off). Therefore, the output voltage VOUT may be lower than the target level during the overdriving period. The target level may be complied with the level of the input voltage VIN. The feedback voltage VFB1 is not provided to the second input terminal of the output buffer 100 during the normal driving period (now the feedback switch SW1 is turned on). Therefore, the output voltage VOUT may be recovered back to the target level (for example, the level of the input voltage VIN) during the normal driving period.

Figure 11:
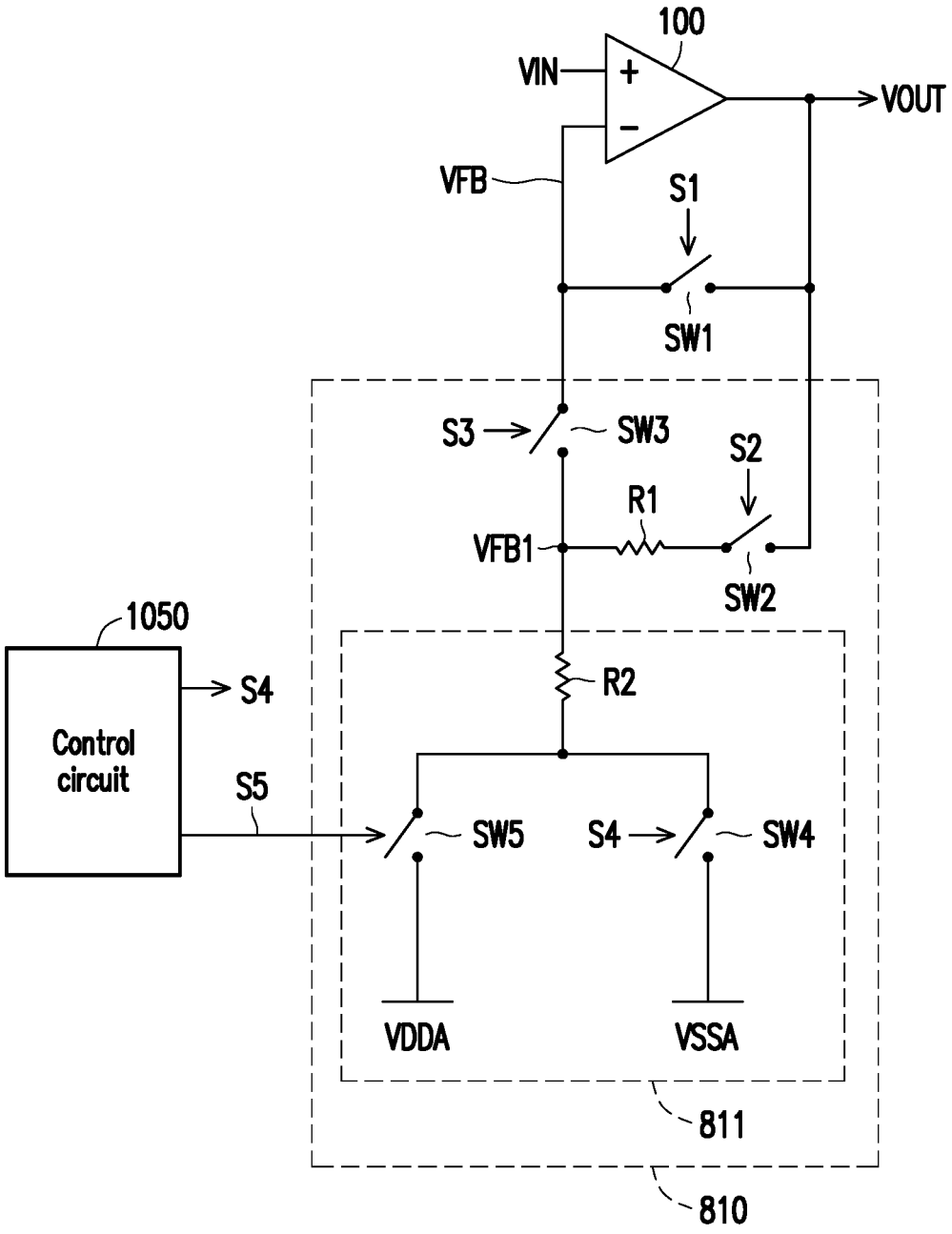
FIG. 11 is a circuit block schematic diagram of an impedance circuit shown in FIG. 10 according to another embodiment of the invention.

FIG. 11 is a circuit block schematic diagram of the impedance circuit 811 shown in FIG. 10 according to an embodiment of the invention. In the embodiment of FIG. 11, the impedance circuit 811 includes a voltage dividing resistor R2, a switch SW4 and a switch SW5. A first terminal of the voltage dividing resistor R2 is coupled to the second terminal of the voltage dividing resistor R1. A resistance proportion of the voltage dividing resistor R1 to the voltage dividing resistor R2 may be determined according to an actual design requirement. The voltage dividing resistor R1 and the voltage dividing resistor R2 may perform a voltage dividing operation to generate the feedback voltage VFB1 related to the output voltage VOUT.

A first terminal of the switch SW4 and a first terminal of the switch SW5 are commonly coupled to a second terminal of the voltage dividing resistor R2. A second terminal of the switch SW4 is coupled to the reference voltage VSSA. According to a design requirement, the reference voltage VSSA may be any voltage lower than the output voltage VOUT, for example, a ground voltage or other fixed voltage. A second terminal of the switch SW5 is coupled to the system voltage VDDA. According to a design requirement, the system voltage VDDA may be any voltage higher than the output voltage VOUT. The switch SW4 is controlled by a control signal S4 of the control circuit 1050, and the switch SW5 is controlled by a control signal S5 of the control circuit 1050. When the input voltage VIN is under the rising mode, the control circuit 1050 turns on the switch SW4 and turns off the switch SW5. When the input voltage VIN is under the falling mode, the control circuit 1050 turns off the switch SW4 and turns on the switch SW5.

Figure 12:
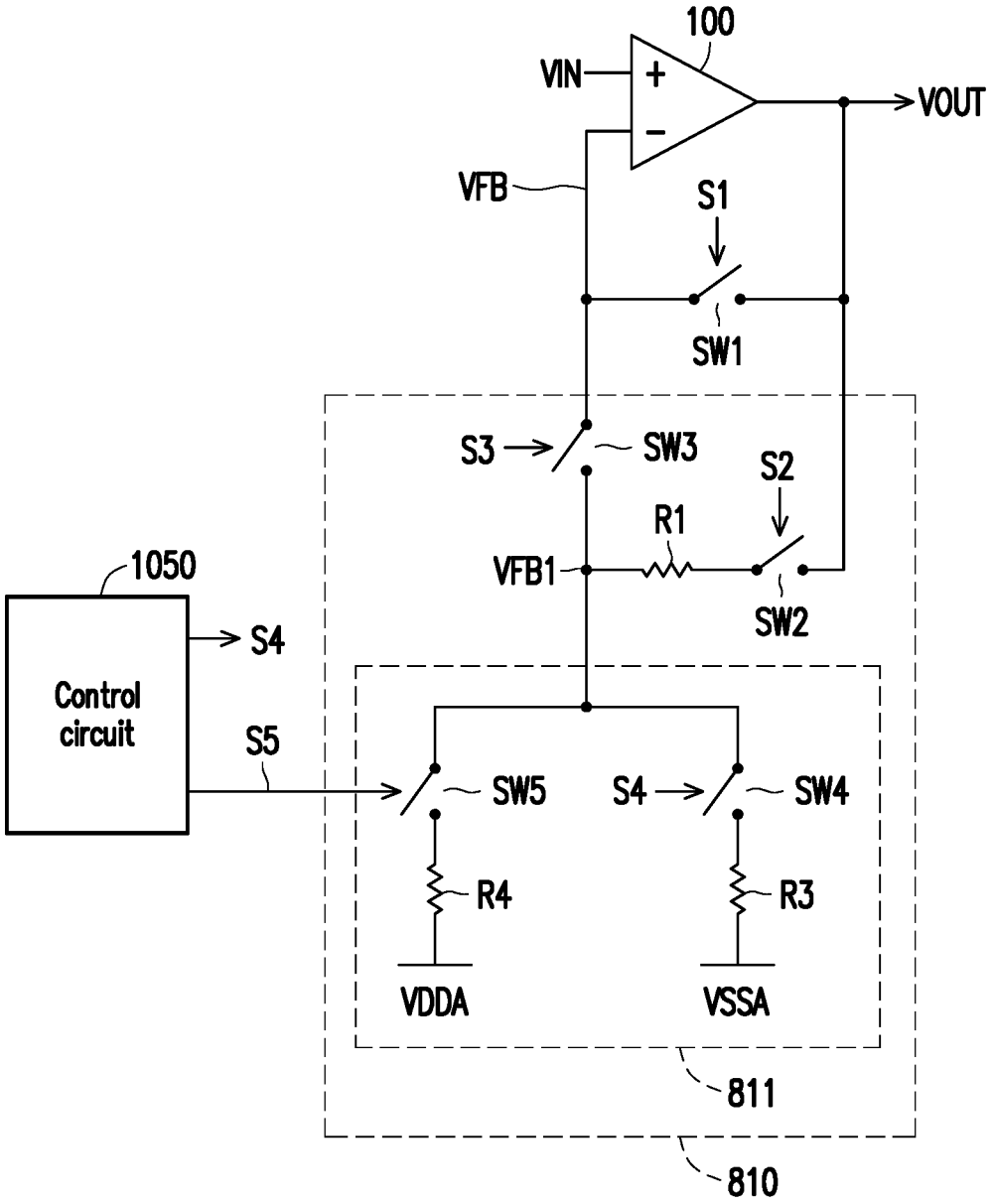
FIG. 12 is a circuit block schematic diagram of an impedance circuit shown in FIG. 10 according to still another embodiment of the invention.

FIG. 12 is a circuit block schematic diagram of the impedance circuit 811 shown in FIG. 10 according to still another embodiment of the invention. In the embodiment of FIG. 12, the impedance circuit 811 includes a voltage dividing resistor R3, a voltage dividing resistor R4, a switch SW4 and a switch SW5. A first terminal of the switch SW4 is coupled to the second terminal of the voltage dividing resistor R1. A first terminal of the voltage dividing resistor R3 is coupled to a second terminal of the switch SW4. A second terminal of the voltage dividing resistor R3 is coupled to the reference voltage VSSA. According to a design requirement, the reference voltage VSSA may be any voltage lower than the output voltage VOUT, for example, the ground voltage or other fixed voltage. The switch SW4 is controlled by the control signal S4 of the control circuit 1050. When the input voltage VIN is under the rising mode, the control circuit 1050 turns on the switch SW4. When the input voltage VIN is under the falling mode, the control circuit 1050 turns off the switch SW4.

A first terminal of the switch SW5 is coupled to the second terminal of the voltage dividing resistor R1. A first terminal of the voltage dividing resistor R4 is coupled to a second terminal of the switch SW5. A second terminal of the voltage dividing resistor R4 is coupled to the system voltage VDDA. According to a design requirement, the reference voltage VDDA may be any voltage higher than the output voltage VOUT. The switch SW5 is controlled by the control signal S5 of the control circuit 1050. When the input voltage VIN is under the rising mode, the control circuit 1050 turns off the switch SW5. When the input voltage VIN is under the falling mode, the control circuit 1050 turns on the switch SW5.

A resistance of the voltage dividing resistor R3 and a resistance of the voltage dividing resistor R4 may be determined according to a design requirement. For example, the resistance of the voltage dividing resistor R3 may be different to the resistance of the voltage dividing resistor R4. Therefore, when the input voltage VIN is under the rising mode, the voltage dividing resistor R1 and the voltage dividing resistor R3 may provide a first resistance proportion. When the input voltage VIN is under the falling mode, the voltage dividing resistor R1 and the voltage dividing resistor R4 may provide a second resistance proportion, where the second resistance proportion is different to the first resistance proportion.

Figure 13:
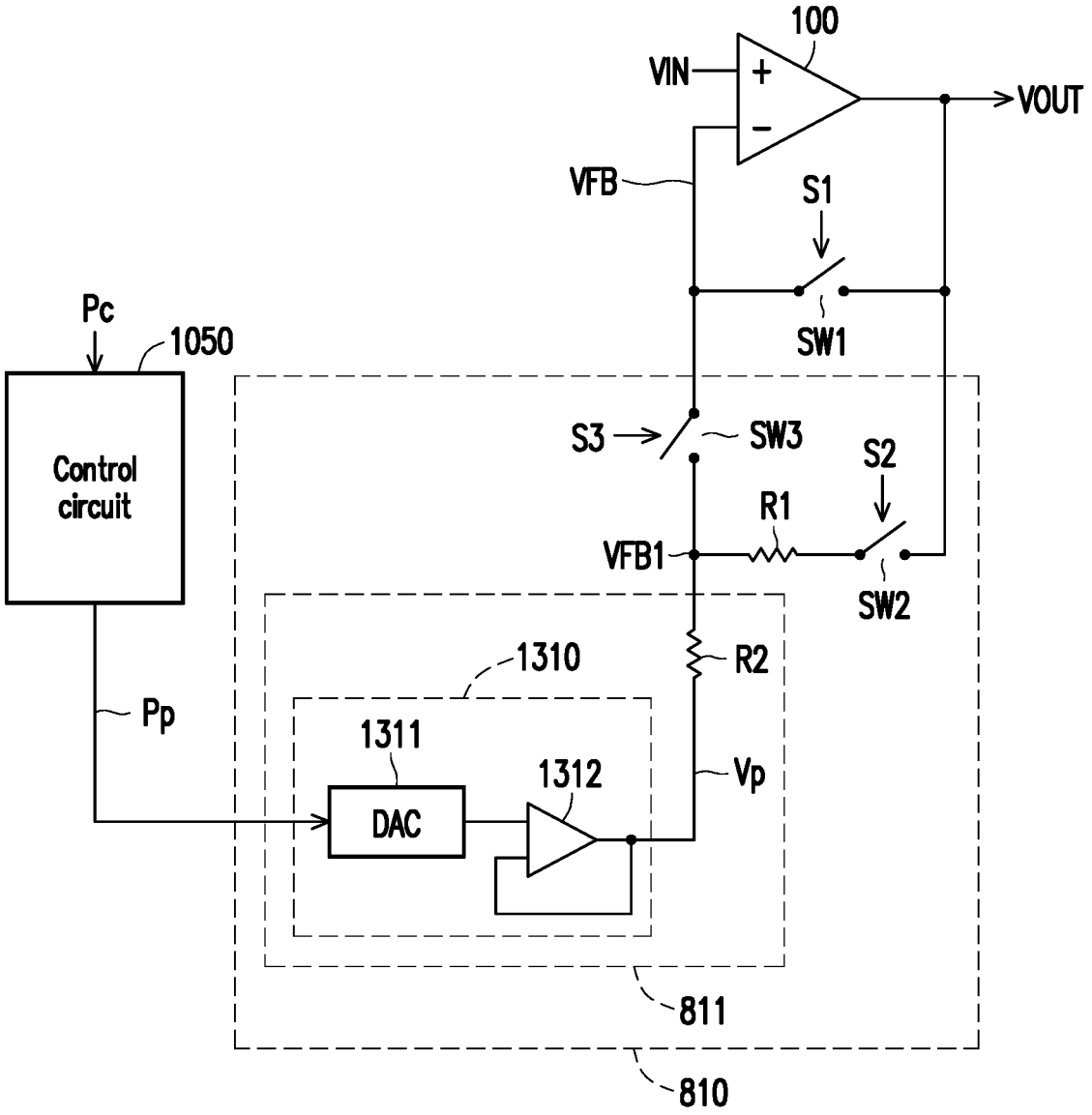
FIG. 13 is a circuit block schematic diagram of an impedance circuit shown in FIG. 10 according to still another embodiment of the invention.

FIG. 13 is a circuit block schematic diagram of the impedance circuit 811 shown in FIG. 10 according to still another embodiment of the invention. In the embodiment of FIG. 13, the impedance circuit 811 includes a voltage dividing resistor R2 and a DAC circuit 1310. A first terminal of the voltage dividing resistor R2 is coupled to the second terminal of the voltage dividing resistor R1. Description of the voltage dividing resistor R2 shown in FIG. 13 may refer to related description of the voltage dividing resistor R2 of FIG. 11, and detail thereof is not repeated.

The control circuit 1050 may record the current pixel data Pc in the previous scan line period to serve as previous pixel data Pp. An input terminal of the DAC circuit 1310 is coupled to the control circuit 1050 to receive the previous pixel data Pp. An output terminal of the DAC circuit 1310 is coupled to the second terminal of the voltage dividing resistor R2. The DAC circuit 1310 may convert the previous pixel data Pp into a previous voltage Vp. The DAC circuit 1310 may output the previous voltage Vp to the second terminal of the voltage dividing resistor R2. When the current pixel data Pc is greater than the previous pixel data Pp and the driving channel circuit 12_1 is operated in the positive polarity, the input voltage VIN related to the current pixel data Pc is greater than the previous voltage Vp related to the previous pixel data Pp, so that the feedback voltage VFB1 is lower than the output voltage VOUT. When the current pixel data Pc is smaller than the previous pixel data Pp and the driving channel circuit 12_1 is operated in the positive polarity, the input voltage VIN related to the current pixel data Pc is smaller than the previous voltage Vp related to the previous pixel data Pp, so that the feedback voltage VFB1 is higher than the output voltage VOUT.

When the current pixel data Pc is smaller than the previous pixel data Pp and the driving channel circuit 12_1 is operated in the negative polarity, the input voltage VIN related to the current pixel data Pc is greater than the previous voltage Vp related to the previous pixel data Pp, so that the feedback voltage VFB1 is lower than the output voltage VOUT. When the current pixel data Pc is greater than the previous pixel data Pp and the driving channel circuit 12_1 is operated in the negative polarity, the input voltage VIN related to the current pixel data Pc is smaller than the previous voltage Vp related to the previous pixel data Pp, so that the feedback voltage VFB1 is higher than the output voltage VOUT.

In another embodiments, according to different design requirements, when the current pixel data Pc is smaller than the previous pixel data Pp and the driving channel circuit 12_1 is operated in the positive polarity, the input voltage VIN related to the current pixel data Pc is smaller than the previous voltage Vp related to the previous pixel data Pp, so that the feedback voltage VFB1 is lower than the output voltage VOUT. When the current pixel data Pc is greater than the previous pixel data Pp and the driving channel circuit 12_1 is operated in the positive polarity, the input voltage VIN related to the current pixel data Pc is greater than the previous voltage Vp related to the previous pixel data Pp, so that the feedback voltage VFB1 is higher than the output voltage VOUT.

In another embodiments, when the current pixel data Pc is greater than the previous pixel data Pp and the driving channel circuit 12_1 is operated in the negative polarity, the input voltage VIN related to the current pixel data Pc is smaller than the previous voltage Vp related to the previous pixel data Pp, so that the feedback voltage VFB1 is lower than the output voltage VOUT. When the current pixel data Pc is smaller than the previous pixel data Pp and the driving channel circuit 12_1 is operated in the negative polarity, the input voltage VIN related to the current pixel data Pc is greater than the previous voltage Vp related to the previous pixel data Pp, so that the feedback voltage VFB1 is higher than the output voltage VOUT.

In the embodiment of FIG. 13, the DAC circuit 1310 includes a DAC 1311 and a unit gain buffer 1312. An input terminal of the DAC 1311 is coupled to the control circuit 1050 to receive the previous pixel data Pp. An input terminal of the unit gain buffer 1312 is coupled to an output terminal of the DAC 1311. An output terminal of the unit gain buffer 1312 is coupled to the second terminal of the voltage dividing resistor R2 to provide the previous voltage Vp. The DAC circuit 1310 may dynamically change the previous voltage Vp according to the previous pixel data Pp. In other embodiments, the DAC circuit 1310 may freely set the previous voltage Vp as the system voltage VDDA, the reference voltage VSSA or any other voltage.

Figure 14:
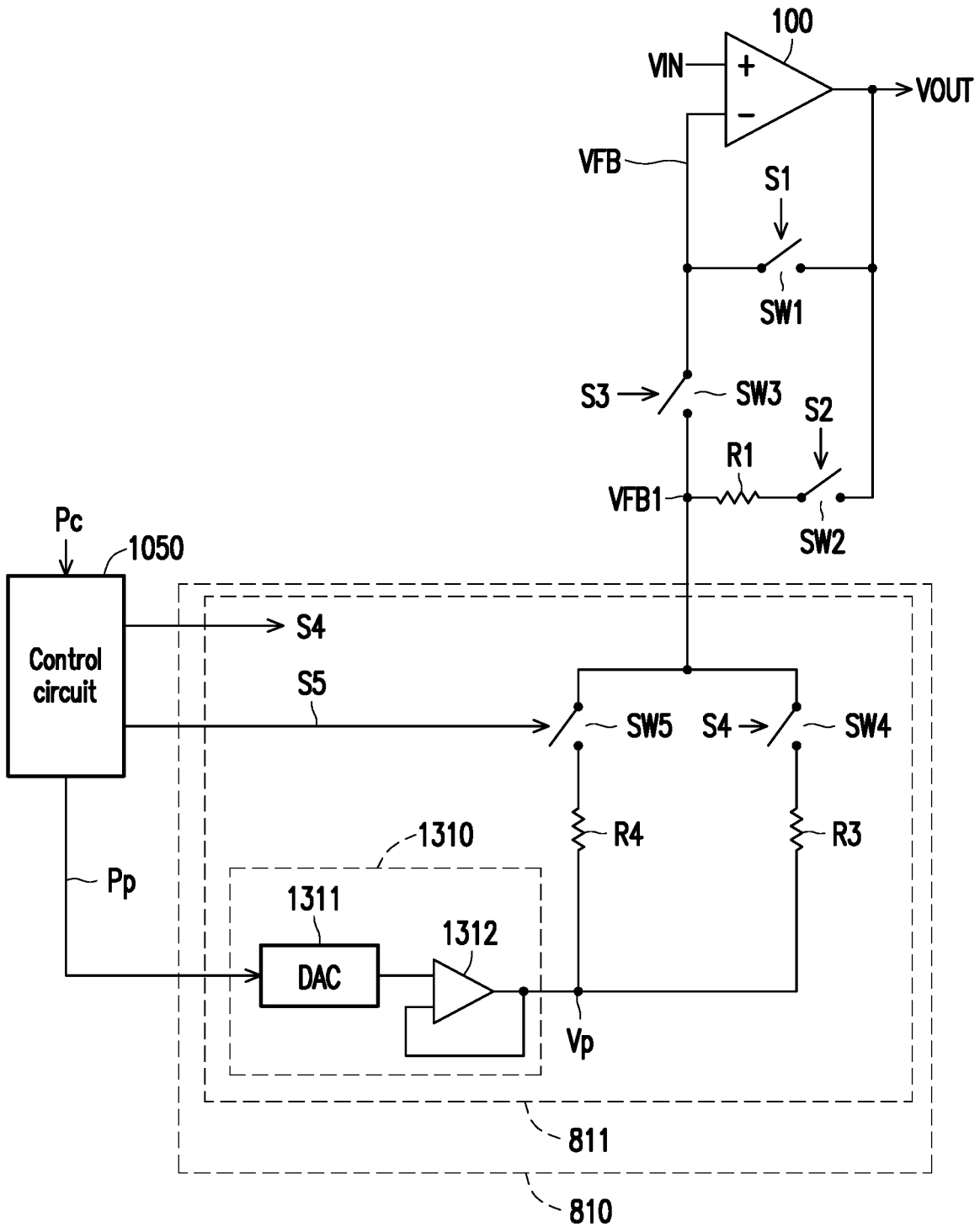
FIG. 14 is a circuit block schematic diagram of an impedance circuit shown in FIG. 10 according to still another embodiment of the invention.

FIG. 14 is a circuit block schematic diagram of the impedance circuit 811 shown in FIG. 10 according to still another embodiment of the invention. In the embodiment of FIG. 14, the impedance circuit 811 includes the voltage dividing resistor R3, the voltage dividing resistor R4, the switch SW4, the switch SW5 and the DAC circuit 1310. Description of the voltage dividing resistor R3, the voltage dividing resistor R4, the switch SW4 and the switch SW5 of FIG. 14 may refer to related description of the voltage dividing resistor R3, the voltage dividing resistor R4, the switch SW4 and the switch SW5 of FIG. 12, and detail thereof is not repeated.

The first terminal of the voltage dividing resistor R3 is coupled to the second terminal of the switch SW4. The first terminal of the voltage dividing resistor R4 is coupled to the second terminal of the switch SW5. The output terminal of the DAC circuit 1310 is coupled to the second terminal of the voltage dividing resistor R3 and the second terminal of the voltage dividing resistor R4. The DAC circuit 1310 may convert the previous pixel data Pp into the previous voltage Vp. The DAC circuit 1310 may output the previous voltage Vp to the second terminal of the voltage dividing resistor R3 and the second terminal of the voltage dividing resistor R4. Related description of the DAC circuit 1310 of FIG. 14 may refer to related description of the DAC circuit 1310 of FIG. 13, and detail thereof is not repeated.

According to different design requirements, the block of the control circuit 1050 may be implemented in form of hardware, firmware, software (i.e. program) or a combination thereof. Regarding the hardware form, the block of the control circuit 1050 may be implemented as a logic circuit on an integrated circuit. Related functions of the control circuit 1050 may be implemented as hardware by using hardware description languages such as Verilog HDL (VHDL) or other proper programming language. For example, the related functions of the control circuit 1050 may be implemented as various logic blocks, modules, and circuits in one or a plurality of controllers, a microcontroller, a microprocessor, an Application-Specific Integrated Circuit (ASIC), a Digital Signal Processor (DSP), a Field Programmable Gate Array (FPGA) and/or other processing unit.

In summary, the source driver 12 and the output buffer 100 thereof in the embodiments of the invention may selectively change the feedback voltage VFB of the output butter 100. A period for driving one pixel may include the overdriving period and the normal driving period. The feedback circuit 800 in the source driver 12 may increase (or decrease) the feedback voltage VFB of the output buffer 100 during the overdriving period, and the output buffer 100 may compare the input voltage VIN with the feedback voltage VFB. When the comparison result indicates that the feedback voltage is to be pulled up, the gate control voltage PGATE and the gate control voltage NGATE of the output stage circuit 120 of the output buffer 100 are pulled down to increase the slew rate of the output voltage VOUT. When the feedback voltage VFB is to be pulled down, the gate control voltage PGATE and the gate control voltage NGATE of the output stage circuit 120 of the output buffer 100 are pulled up to increase the slew rate of the output voltage VOUT. Therefore, the source driver 12 of the invention may perform overdriving to the output voltage VOUT within a short time.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A source driver, comprising an output buffer and a feedback circuit, wherein the output buffer comprises:

an input stage circuit, having a first input terminal and a second input terminal, wherein the first input terminal of the input stage circuit receives an input voltage of the output buffer, the second input terminal of the input stage circuit is coupled to an output terminal of the feedback circuit to receive a first feedback voltage, and the input stage circuit is configured to correspondingly generate a first gate control voltage and a second gate control voltage according to the input voltage and the first feedback voltage;

an output stage circuit, coupled to the input stage circuit to receive the first gate control voltage and the second gate control voltage, and configured to correspondingly generate an output voltage of the output buffer to a data line of a display panel according to the first gate control voltage and the second gate control voltage, wherein an output terminal of the output stage circuit is coupled to an input terminal of the feedback circuit;

a rising control circuit, configured to compare the input voltage with the first feedback voltage to obtain a first comparison result, wherein when the first comparison result indicates that the first feedback voltage is to be pulled up, the rising control circuit pulls down the first gate control voltage and the second gate control voltage during a first transient period; and a falling control circuit, configured to compare the input voltage with the first feedback voltage to obtain a second comparison result, wherein when the second comparison result indicates that the first feedback voltage is to be pulled down, the falling control circuit pulls up the first gate control voltage and the second gate control voltage during a second transient period, wherein the feedback circuit is configured to generate and output the first feedback voltage related to the output voltage to the second input terminal of the input stage circuit.

2. The source driver as claimed in claim 1, wherein the output stage circuit comprises:

a first transistor, having a control terminal coupled to the input stage circuit to receive the first gate control voltage, wherein a first terminal of the first transistor is coupled to a system voltage, and a second terminal of the first transistor is coupled to the output terminal of the output stage circuit; and a second transistor, having a control terminal coupled to the input stage circuit to receive the second gate control voltage, wherein a first terminal of the second transistor is coupled to a reference voltage, and a second terminal of the second transistor is coupled to the output terminal of the output stage circuit.

3. The source driver as claimed in claim 1, wherein when the input voltage is greater than the first feedback voltage, the rising control circuit pulls down the first gate control voltage and the second gate control voltage, and when the input voltage is smaller than or equal to the first feedback voltage, the rising control circuit does not adjust the first gate control voltage and the second gate control voltage.

4. The source driver as claimed in claim 1, wherein the rising control circuit comprises:

a comparing circuit, configured to compare the input voltage with the first feedback voltage to generate a control voltage to serve as the first comparison result;

a first transistor, having a control terminal coupled to an output terminal of the comparing circuit to receive the control voltage, wherein a first terminal of the first transistor is coupled to a reference voltage, and a second terminal of the first transistor is coupled to a first input terminal of the output stage circuit to receive the first gate control voltage; and a second transistor, having a control terminal coupled to the output terminal of the comparing circuit to receive the control voltage, wherein a first terminal of the second transistor is coupled to the reference voltage, and a second terminal of the second transistor is coupled to a second input terminal of the output stage circuit to receive the second gate control voltage.

5. The source driver as claimed in claim 4, wherein the comparing circuit comprises:

a third transistor, having a control terminal coupled to the input voltage, wherein a first terminal of the third transistor is coupled to the first feedback voltage;

a current mirror, having a master current terminal coupled to a second terminal of the third transistor, wherein a slave current terminal of the current mirror is coupled to the output terminal of the comparing circuit; and a fourth transistor, having a control terminal coupled to the output terminal of the comparing circuit, wherein a first terminal of the fourth transistor is coupled to the reference voltage, and a second terminal of the fourth transistor is coupled to the slave current terminal of the current mirror.

6. The source driver as claimed in claim 4, wherein the comparing circuit comprises:

a third transistor, having a control terminal coupled to the input voltage, wherein a first terminal of the third transistor is coupled to the first feedback voltage;

a fourth transistor, having a control terminal controlled by a first control signal, wherein a first terminal of the fourth transistor is coupled to a second terminal of the third transistor;

a current mirror, having a master current terminal coupled to a second terminal of the fourth transistor, wherein a slave current terminal of the current mirror is coupled to the output terminal of the comparing circuit;

a fifth transistor, having a control terminal controlled by the first control signal, wherein a first terminal of the fifth transistor is coupled to a system voltage, and a second terminal of the fifth transistor is coupled to an enabling terminal of the current mirror; and a sixth transistor, having a control terminal coupled to the output terminal of the comparing circuit, wherein a first terminal of the sixth transistor is coupled to the reference voltage, and a second terminal of the sixth transistor is coupled to the slave current terminal of the current mirror.

7. The source driver as claimed in claim 6, wherein the comparing circuit further comprises:

a seventh transistor, having a control terminal controlled by a second control signal, wherein a first terminal of the seventh transistor is coupled to the reference voltage, and a second terminal of the seventh transistor is coupled to the control terminal of the sixth transistor.

8. The source driver as claimed in claim 1, wherein when the input voltage is smaller than the first feedback voltage, the falling control circuit pulls up the first gate control voltage and the second gate control voltage, and when the input voltage is greater than or equal to the first feedback voltage, the falling control circuit does not adjust the first gate control voltage and the second gate control voltage.

9. The source driver as claimed in claim 1, wherein the falling control circuit comprises:

a comparing circuit, configured to compare the input voltage with the first feedback voltage to generate a control voltage to serve as the second comparison result;

a first transistor, having a control terminal coupled to an output terminal of the comparing circuit to receive the control voltage, wherein a first terminal of the first transistor is coupled to a system voltage, and a second terminal of the first transistor is coupled to a first input terminal of the output stage circuit to receive the first gate control voltage; and a second transistor, having a control terminal coupled to the output terminal of the comparing circuit to receive the control voltage, wherein a first terminal of the second transistor is coupled to the system voltage, and a second terminal of the second transistor is coupled to a second input terminal of the output stage circuit to receive the second gate control voltage.

10. The source driver as claimed in claim 9, wherein the comparing circuit comprises:

a third transistor, having a control terminal coupled to the input voltage, wherein a first terminal of the third transistor is coupled to the first feedback voltage;

a current mirror, having a master current terminal coupled to a second terminal of the third transistor, wherein a slave current terminal of the current mirror is coupled to the output terminal of the comparing circuit; and a fourth transistor, having a control terminal coupled to the output terminal of the comparing circuit, wherein a first terminal of the fourth transistor is coupled to the system voltage, and a second terminal of the fourth transistor is coupled to the slave current terminal of the current mirror.

11. The source driver as claimed in claim 9, wherein the comparing circuit comprises:

a third transistor, having a control terminal coupled to the input voltage, wherein a first terminal of the third transistor is coupled to the first feedback voltage;

a fourth transistor, having a control terminal controlled by a first control signal, wherein a first terminal of the fourth transistor is coupled to a second terminal of the third transistor;

a current mirror, having a master current terminal coupled to a second terminal of the fourth transistor, wherein a slave current terminal of the current mirror is coupled to the output terminal of the comparing circuit;

a fifth transistor, having a control terminal controlled by the first control signal, wherein a first terminal of the fifth transistor is coupled to a reference voltage, and a second terminal of the fifth transistor is coupled to an enabling terminal of the current mirror; and a sixth transistor, having a control terminal coupled to the output terminal of the comparing circuit, wherein a first terminal of the sixth transistor is coupled to the system voltage, and a second terminal of the sixth transistor is coupled to the slave current terminal of the current mirror.

12. The source driver as claimed in claim 11, wherein the comparing circuit further comprises:

a seventh transistor, having a control terminal controlled by a second control signal, wherein a first terminal of the seventh transistor is coupled to the system voltage, and a second terminal of the seventh transistor is coupled to the control terminal of the sixth transistor.

13. The source driver as claimed in claim 1, wherein the feedback circuit comprises:

a feedback switch, having a first terminal and a second terminal respectively coupled to the second input terminal of the input stage circuit and the output terminal of the output stage circuit, wherein the feedback switch is turned off during an overdriving period, and the feedback switch is turned on during a normal driving period to transmit the output voltage as the first feedback voltage to the second input terminal of the input stage circuit; and a feedback voltage generating circuit, configured to generate and output a second feedback voltage related to the output voltage to serve as the first feedback voltage to the second input terminal of the input stage circuit during the overdriving period, and not to output the second feedback voltage to the second input terminal of the input stage circuit during the normal driving period, wherein when the input voltage is under a rising mode, the second feedback voltage is lower than the output voltage, and when the input voltage is under a falling mode, the second feedback voltage is higher than the output voltage.

14. The source driver as claimed in claim 13, further comprising:

a digital-to-analog converter, coupled to the first input terminal of the input stage circuit, configured to convert a current pixel data into the input voltage, and output the input voltage to the first input terminal of the input stage circuit, wherein "the input voltage is under the rising mode" is defined as "the input voltage corresponding to the current pixel data is greater than the input voltage corresponding to a previous pixel data", and "the input voltage is under the falling mode" is defined as "the input voltage corresponding to the current pixel data is smaller than the input voltage corresponding to the previous pixel data".

15. The source driver as claimed in claim 13, further comprising:

a digital-to-analog converter, coupled to the first input terminal of the input stage circuit, configured to convert a current pixel data into the input voltage, and output the input voltage to the first input terminal of the input stage circuit, wherein "the input voltage is under the rising mode" is defined as "the input voltage corresponding to the current pixel data is smaller than the input voltage corresponding to a previous pixel data", and "the input voltage is under the falling mode" is defined as "the input voltage corresponding to the current pixel data is greater than the input voltage corresponding to the previous pixel data".

16. The source driver as claimed in claim 13, wherein the data line is coupled to a near pixel circuit and a far pixel circuit of the display panel, a distance between the near pixel circuit and the source driver is smaller than a distance between the far pixel circuit and the source driver, and the overdriving period related to the near pixel circuit is smaller than the overdriving period related to the far pixel circuit.

17. The source driver as claimed in claim 13, wherein the feedback voltage generating circuit comprises:

a first switch, having a first terminal coupled to the output terminal of the output stage circuit, wherein the first switch is turned on during the overdriving period, and the first switch is turned off during the normal driving period;

a second switch, having a first terminal coupled to the second input terminal of the input stage circuit, wherein the second switch is turned on during the overdriving period, and the second switch is turned off during the normal driving period;

a first voltage dividing resistor, having a first terminal coupled to a second terminal of the first switch, wherein a second terminal of the first voltage dividing resistor is coupled to a second terminal of the second switch; and an impedance circuit, coupled to the second terminal of the first voltage dividing resistor.

18. The source driver as claimed in claim 17, wherein the impedance circuit comprises:

a second voltage dividing resistor, having a first terminal coupled to the second terminal of the first voltage dividing resistor;

a third switch, having a first terminal coupled to a second terminal of the second voltage dividing resistor, wherein a second terminal of the third switch is coupled to a reference voltage, the reference voltage is lower than the output voltage, the third switch is turned on when the input voltage is under the rising mode, and the third switch is turned off when the input voltage is under the falling mode; and a fourth switch, having a first terminal coupled to the second terminal of the second voltage dividing resistor, wherein a second terminal of the fourth switch is coupled to a system voltage, the system voltage is higher than the output voltage, the fourth switch is turned off when the input voltage is under the rising mode, and the fourth switch is turned on when the input voltage is under the falling mode.

19. The source driver as claimed in claim 17, wherein the impedance circuit comprises:

a third switch, having a first terminal coupled to the second terminal of the first voltage dividing resistor, wherein the third switch is turned on when the input voltage is under the rising mode, and the third switch is turned off when the input voltage is under the falling mode;

a second voltage dividing resistor, having a first terminal coupled to a second terminal of the third switch, wherein a second terminal of the second voltage dividing resistor is coupled to a reference voltage, and the reference voltage is lower than the output voltage;

a fourth switch, having a first terminal coupled to the second terminal of the first voltage dividing resistor, wherein the fourth switch is turned off when the input voltage is under the rising mode, and the fourth switch is turned on when the input voltage is under the falling mode; and a third voltage dividing resistor, having a first terminal coupled to a second terminal of the fourth switch, wherein a second terminal of the third voltage dividing resistor is coupled to a system voltage, and the system voltage is higher than the output voltage.

20. The source driver as claimed in claim 17, wherein the impedance circuit comprises:

a second voltage dividing resistor, having a first terminal coupled to the second terminal of the first voltage dividing resistor; and a digital-to-analog conversion circuit, having an output terminal coupled to a second terminal of the second voltage dividing resistor, and configured to convert a previous pixel data into a previous voltage, and output the previous voltage to the second terminal of the second voltage dividing resistor.

21. The source driver as claimed in claim 20, wherein the digital-to-analog conversion circuit comprises:

a digital-to-analog converter, having an input terminal configured to receive the previous pixel data; and a unit gain buffer, having an input terminal coupled to an output terminal of the digital-to-analog converter, wherein an output terminal of the unit gain buffer is coupled to the second terminal of the second voltage dividing resistor to supply the previous voltage.

22. The source driver as claimed in claim 17, wherein the impedance circuit comprises:

a third switch, having a first terminal coupled to the second terminal of the first voltage dividing resistor, wherein the third switch is turned on when the input voltage is under the rising mode, and the third switch is turned off when the input voltage is under the falling mode;

a second voltage dividing resistor, having a first terminal coupled to a second terminal of the third switch;

a fourth switch, having a first terminal coupled to the second terminal of the first voltage dividing resistor, wherein the fourth switch is turned off when the input voltage is under the rising mode, and the fourth switch is turned on when the input voltage is under the falling mode;

a third voltage dividing resistor, having a first terminal coupled to a second terminal of the fourth switch; and a digital-to-analog conversion circuit, having an output terminal coupled to a second terminal of the second voltage dividing resistor and a second terminal of the third voltage dividing resistor, configured to convert a previous pixel data into a previous voltage, and output the previous voltage to the second terminal of the second voltage dividing resistor and the second terminal of the third voltage dividing resistor.

23. An output buffer, comprising:

an input stage circuit, having a first input terminal and a second input terminal, wherein the first input terminal of the input stage circuit is configured to receive an input voltage of the output buffer, and the second input terminal of the input stage circuit is configured to receive a first feedback voltage of the output buffer, and the input stage circuit correspondingly generates a first gate control voltage and a second gate control voltage according to the input voltage and the first feedback voltage;

an output stage circuit, coupled to the input stage circuit to receive the first gate control voltage and the second gate control voltage, and configured to correspondingly generate an output voltage of the output buffer according to the first gate control voltage and the second gate control voltage;

a rising control circuit, configured to compare the input voltage with the first feedback voltage to obtain a first comparison result, wherein when the first comparison result indicates that the first feedback voltage is to be pulled up, the rising control circuit pulls down the first gate control voltage and the second gate control voltage during a first transient period; and a falling control circuit, configured to compare the input voltage with the first feedback voltage to obtain a second comparison result, wherein when the second comparison result indicates that the first feedback voltage is to be pulled down, the falling control circuit pulls up the first gate control voltage and the second gate control voltage during a second transient period.

24. The output buffer as claimed in claim 23, wherein the output stage circuit comprises:

a first transistor, having a control terminal coupled to the input stage circuit to receive the first gate control voltage, wherein a first terminal of the first transistor is coupled to a system voltage, a second terminal of the first transistor is coupled to an output terminal of the output stage circuit, and the output terminal of the output stage circuit outputs the output voltage of the output buffer; and a second transistor, having a control terminal coupled to the input stage circuit to receive the second gate control voltage, wherein a first terminal of the second transistor is coupled to a reference voltage, and a second terminal of the second transistor is coupled to the output terminal of the output stage circuit.

25. The output buffer as claimed in claim 23, wherein when the input voltage is greater than the first feedback voltage, the rising control circuit pulls down the first gate control voltage and the second gate control voltage, and when the input voltage is smaller than or equal to the first feedback voltage, the rising control circuit does not adjust the first gate control voltage and the second gate control voltage.

26. The output buffer as claimed in claim 23, wherein the rising control circuit comprises:

a comparing circuit, configured to compare the input voltage with the first feedback voltage to generate a control voltage to serve as the first comparison result;

a first transistor, having a control terminal coupled to an output terminal of the comparing circuit to receive the control voltage, wherein a first terminal of the first transistor is coupled to a reference voltage, and a second terminal of the first transistor is coupled to a first input terminal of the output stage circuit to receive the first gate control voltage; and a second transistor, having a control terminal coupled to the output terminal of the comparing circuit to receive the control voltage, wherein a first terminal of the second transistor is coupled to the reference voltage, and a second terminal of the second transistor is coupled to a second input terminal of the output stage circuit to receive the second gate control voltage.

27. The output buffer as claimed in claim 26, wherein the comparing circuit comprises:

a third transistor, having a control terminal coupled to the input voltage, wherein a first terminal of the third transistor is coupled to the first feedback voltage;

a current mirror, having a master current terminal coupled to a second terminal of the third transistor, wherein a slave current terminal of the current mirror is coupled to the output terminal of the comparing circuit; and a fourth transistor, having a control terminal coupled to the output terminal of the comparing circuit, wherein a first terminal of the fourth transistor is coupled to the reference voltage, and a second terminal of the fourth transistor is coupled to the slave current terminal of the current mirror.

28. The output buffer as claimed in claim 26, wherein the comparing circuit comprises:

a third transistor, having a control terminal coupled to the input voltage, wherein a first terminal of the third transistor is coupled to the first feedback voltage;

a fourth transistor, having a control terminal controlled by a first control signal, wherein a first terminal of the fourth transistor is coupled to a second terminal of the third transistor;

a current mirror, having a master current terminal coupled to a second terminal of the fourth transistor, wherein a slave current terminal of the current mirror is coupled to the output terminal of the comparing circuit;

a fifth transistor, having a control terminal controlled by the first control signal, wherein a first terminal of the fifth transistor is coupled to a system voltage, and a second terminal of the fifth transistor is coupled to an enabling terminal of the current mirror; and a sixth transistor, having a control terminal coupled to the output terminal of the comparing circuit, wherein a first terminal of the sixth transistor is coupled to the reference voltage, and a second terminal of the sixth transistor is coupled to the slave current terminal of the current mirror.

29. The output buffer as claimed in claim 28, wherein the comparing circuit further comprises:

a seventh transistor, having a control terminal controlled by a second control signal, wherein a first terminal of the seventh transistor is coupled to the reference voltage, and a second terminal of the seventh transistor is coupled to the control terminal of the sixth transistor.

30. The output buffer as claimed in claim 23, wherein when the input voltage is smaller than the first feedback voltage, the falling control circuit pulls up the first gate control voltage and the second gate control voltage, and when the input voltage is greater than or equal to the first feedback voltage, the falling control circuit does not adjust the first gate control voltage and the second gate control voltage.

31. The output buffer as claimed in claim 23, wherein the falling control circuit comprises:

a comparing circuit, configured to compare the input voltage with the first feedback voltage to generate a control voltage to serve as the second comparison result;

a first transistor, having a control terminal coupled to an output terminal of the comparing circuit to receive the control voltage, wherein a first terminal of the first transistor is coupled to a system voltage, and a second terminal of the first transistor is coupled to a first input terminal of the output stage circuit to receive the first gate control voltage; and a second transistor, having a control terminal coupled to the output terminal of the comparing circuit to receive the control voltage, wherein a first terminal of the second transistor is coupled to the system voltage, and a second terminal of the second transistor is coupled to a second input terminal of the output stage circuit to receive the second gate control voltage.

32. The output buffer as claimed in claim 31, wherein the comparing circuit comprises:

a third transistor, having a control terminal coupled to the input voltage, wherein a first terminal of the third transistor is coupled to the first feedback voltage;

a current mirror, having a master current terminal coupled to a second terminal of the third transistor, wherein a slave current terminal of the current mirror is coupled to the output terminal of the comparing circuit; and a fourth transistor, having a control terminal coupled to the output terminal of the comparing circuit, wherein a first terminal of the fourth transistor is coupled to the system voltage, and a second terminal of the fourth transistor is coupled to the slave current terminal of the current mirror.

33. The output buffer as claimed in claim 31, wherein the comparing circuit comprises:

a third transistor, having a control terminal coupled to the input voltage, wherein a first terminal of the third transistor is coupled to the first feedback voltage;

a fourth transistor, having a control terminal controlled by a first control signal, wherein a first terminal of the fourth transistor is coupled to a second terminal of the third transistor;

a current mirror, having a master current terminal coupled to a second terminal of the fourth transistor, wherein a slave current terminal of the current mirror is coupled to the output terminal of the comparing circuit;

a fifth transistor, having a control terminal controlled by the first control signal, wherein a first terminal of the fifth transistor is coupled to a reference voltage, and a second terminal of the fifth transistor is coupled to an enabling terminal of the current mirror; and a sixth transistor, having a control terminal coupled to the output terminal of the comparing circuit, wherein a first terminal of the sixth transistor is coupled to the system voltage, and a second terminal of the sixth transistor is coupled to the slave current terminal of the current mirror.

34. The output buffer as claimed in claim 33, wherein the comparing circuit further comprises:

a seventh transistor, having a control terminal controlled by a second control signal, wherein a first terminal of the seventh transistor is coupled to the system voltage, and a second terminal of the seventh transistor is coupled to the control terminal of the sixth transistor.

* * * * *